US009914229B2

(12) United States Patent
Fastabend et al.

(10) Patent No.: US 9,914,229 B2
(45) Date of Patent: Mar. 13, 2018

(54) PRODUCE SLICER

(71) Applicant: Prince Castle LLC, Carol Stream, IL (US)

(72) Inventors: Mark Fastabend, Carol Stream, IL (US); Scott Hammac, Joliet, IL (US); Kyle Kestner, Schaumburg, IL (US); Anthony Caringella, Norridge, IL (US); Michael Graef, Naperville, IL (US); Julia Padvoiskis, Chicago, IL (US); Eric Larson, Pecatonica, IL (US)

(73) Assignee: Prince Castle LLC, Carol Stream, IL (US)

( * ) Notice: Subject to any disclaimer, the term of this patent is extended or adjusted under 35 U.S.C. 154(b) by 238 days.

(21) Appl. No.: 14/833,744

(22) Filed: Aug. 24, 2015

(65) Prior Publication Data

US 2016/0229075 A1 Aug. 11, 2016

Related U.S. Application Data

(60) Provisional application No. 62/043,918, filed on Aug. 29, 2014, provisional application No. 62/117,222, filed on Feb. 17, 2015.

(51) Int. Cl.
*B26D 1/02* (2006.01)
*B26D 7/22* (2006.01)
(Continued)

(52) U.S. Cl.
CPC ..... *B26D 1/03* (2013.01); *B26D 3/185* (2013.01); *B26D 7/0608* (2013.01); *B26D 7/225* (2013.01); *B26D 5/10* (2013.01)

(58) Field of Classification Search
CPC ..... B26D 1/03; B26D 7/0608; B26D 7/225; B26D 2007/0018; B26D 2210/02;
(Continued)

(56) References Cited

U.S. PATENT DOCUMENTS 2,563,237 A 6/1947 Grocoff
D164,693 S 10/1951 Kooas
(Continued)

FOREIGN PATENT DOCUMENTS

DE 102004002070 A1 8/2005
EP 1570961 A1 9/2005
(Continued)

OTHER PUBLICATIONS

Edlund, Manual Fruit & Vegetable Slicer, 2014.
(Continued)

*Primary Examiner* — Ghassem Alie
(74) *Attorney, Agent, or Firm* — Andrus Intellectual Property Law, LLP

(57) ABSTRACT

Produce slicers for slicing produce include a frame. A blade assembly is removably and interchangeably received within the frame. A pusher head is removably and interchangeably received within the frame. The produce slicer includes a cover, at least one target ring in the cover defines a first target area. The blade assembly includes at least one blade set with a first frame bar and a second frame bar and a plurality of blades extend therebetween. The pusher head includes a pusher head body and at least one produce pusher with a plurality of fins extending in a direction away from the pusher head body.

15 Claims, 21 Drawing Sheets

(51) Int. Cl.

| | |
|---|---|
| ***B26D 7/06*** | (2006.01) |
| ***B26D 1/03*** | (2006.01) |
| ***B26D 3/18*** | (2006.01) |
| *B26D 5/10* | (2006.01) |

(58) Field of Classification Search

CPC .. B26D 3/185; B26D 5/10; B26D 3/26; Y10T 83/8831

USPC ..... 83/422, 437, 407, 662, 431, 467, 425, 83/425.3, 425.2, 651.1, 404, 404.1, 404.3, 83/408, 858, 932; 99/495, 537, 538, 547, 99/567, 588

See application file for complete search history.

(56) References Cited

U.S. PATENT DOCUMENTS

| | | | | | |
|---|---|---|---|---|---|
| 2,836,212 | A | | 5/1958 | Albert | |
| 2,916,986 | A | * | 12/1959 | Lebovitz | A22C 25/18 100/94 |
| 3,369,582 | A | | 2/1968 | Giangiulio | |
| 3,463,211 | A | | 8/1969 | Holz | |
| 3,605,839 | A | | 9/1971 | Gerson | |
| 3,924,501 | A | | 12/1975 | Cohen et al. | |
| 4,059,037 | A | | 11/1977 | Gerson et al. | |
| 4,062,260 | A | * | 12/1977 | Steinhogl | B26B 5/008 83/404.3 |
| 4,254,678 | A | | 3/1981 | Novy et al. | |
| 4,302,997 | A | | 12/1981 | Jones et al. | |
| 4,436,011 | A | | 3/1984 | Jones | |
| 4,453,458 | A | * | 6/1984 | Altman | A23N 4/12 99/544 |
| 4,567,801 | A | | 2/1986 | Jones | |
| 4,573,384 | A | | 3/1986 | Jones | |
| 4,579,028 | A | * | 4/1986 | Neidhardt | B26D 3/18 83/109 |
| D297,798 | S | | 9/1988 | Leung | |
| 4,870,719 | A | | 10/1989 | Harris | |
| 5,245,902 | A | | 9/1993 | Pereira | |
| 5,343,623 | A | | 9/1994 | Cole et al. | |
| 5,419,245 | A | | 5/1995 | Short | |
| 5,613,903 | A | | 3/1997 | Fujitaki et al. | |
| 5,749,145 | A | | 5/1998 | Baukloh | |
| D400,065 | S | | 10/1998 | Fohrman | |
| 6,041,682 | A | | 3/2000 | Jensen et al. | |
| D505,302 | S | | 5/2005 | Veltrop et al. | |
| D531,465 | S | | 11/2006 | Tellier | |
| 8,495,941 | B2 | * | 7/2013 | Farid | B26D 3/185 30/114 |
| 2006/0185488 | A1 | * | 8/2006 | Short | B26D 1/553 83/581.1 |
| 2006/0225547 | A1 | * | 10/2006 | Stanojevic | B26D 1/553 83/13 |
| 2009/0249935 | A1 | * | 10/2009 | Kaposi | A47J 43/25 83/635 |
| 2010/0313724 | A1 | | 12/2010 | Farid et al. | |
| 2011/0283549 | A1 | | 11/2011 | Moss et al. | |
| 2014/0208917 | A1 | * | 7/2014 | Whitney | B26D 5/16 83/858 |

FOREIGN PATENT DOCUMENTS

| | | | |
|---|---|---|---|
| EP | 1759819 | A1 | 3/2007 |
| GB | 2312613 | A | 11/1997 |

OTHER PUBLICATIONS

Nemco, Operating and Maintenance Instruction for Lettuce Kutter, 2012.

Nemco, Easy Cartride Onion Slicer, 2008.

Prince Castle LLC, Dice Witch, 2009.

Prince Castle LLC, Lettuce Kutlett, 2009.

Prince Castle LLC, Tomato Saber Operating Instructions, 1999.

Vollrath, Onion King Operator's Manual, 2014.

Extended European Search Report issued in the corresponding European Appln. No. 15182754, dated Jan. 19, 2016.

* cited by examiner

PRODUCE SLICER

CROSS REFERENCE TO RELATED APPLICATION

The present application claims priority of U.S. Provisional Patent Application No. 62/043,918, filed on Aug. 29, 2014 and U.S. Provisional Patent Application No. 62/117,222, filed on Feb. 17, 2015, the contents of which are hereby incorporated herein by reference in their entireties.

FIELD OF THE DISCLOSURE

The present disclosure is related to the field of slicing. More specifically, the present application is related to a produce slicer and blade cartridges therefor.

BACKGROUND

Restaurant and food preparation industries require a large volume of produce to be processed such as by slicing so that the sliced produce can be used in food preparation and assembly. In addition to rapid slicing of produce, food preparation requires consistently sliced produce such that the food prepared with that produce is consistent in appearance, taste, texture, portion size, and cooking qualities between servings prepared.

Produce slicing is typically a manually performed task due to the aforementioned desire for consistency. As slicing necessarily requires some form of blade or cutting surface, this naturally involves a desire to seek solutions to improve safety for food preparation workers. Currently available slicing solutions have exposed blade sets which can present a risk to users during set up and operation. Currently available slicing solutions are limited to slicing a single piece of produce at a time.

Areas that are designated for food preparation often have limited space. With currently available slicing solutions, separate devices are used with each device configured to slice different produce. The need to store and maintain multiple devices adds further expense and use of already limited food preparation space.

BRIEF DISCLOSURE

An exemplary produce slicer includes a frame which includes a blade assembly receiving area and a head receiver. A blade assembly is removeably received within the blade assembly receiving area. The produce slicer further includes a cover. The cover includes a first target ring. The first target ring defines a first target area configured to receive a piece of produce to be sliced. A first blade set includes a first frame bar and a second frame bar. A plurality of blades extend between the first frame bar and the second frame bar. A pusher head is removably received within the head receiver. The pusher head includes a pusher head body and a first produce pusher. The first produce pusher includes a plurality of fins extending in a direction away from the pusher head body. The first produce pusher is aligned with the first target ring.

An exemplary produce slicing system is configured for slicing multiple types of produce. The produce slicing system includes a frame which includes a blade assembly receiving area. A pusher assembly includes at least one rail and a head receiver moveably mounted to the at least one rail. A handle is moveably connected to the pusher assembly. The handle is operably configured to move the pusher assembly along the at least one rail. A first blade cartridge is configured for interchangeable engagement with the frame and includes the first blade assembly. The first blade assembly is configured to removably engage the blade assembly receiving area of the frame. The first blade cartridge includes a first cover with a top portion and a plurality of sides extending away from the top portion to define an open interior. At least one target ring extends away from the top portion in a direction opposite the open interior. The at least one target ring defines at least one target area configured to receive produce to be sliced. First and second blade sets each include a first frame bar and a second frame bar. A plurality of blades extend between the first and second frame bars. The first and second blades sets are retained within the open interior of the first cover. A first pusher head is configured to removeably engage the head receiver of the frame. The first pusher head further includes a pusher head body and at least one produce pusher with a plurality of fins extending in a direction away from the pusher head body. The at least one produce pusher is aligned with the at least one target ring. A second blade cartridge, including a second blade assembly and a second pusher head, is configured for interchangeable engagement with the frame. The second blade assembly is configured to removably engage the blade assembly receiving area of the frame. The second blade assembly includes a second cover with a top portion and a plurality of sides extending away from the top portion to define an open interior. At least one target ring extends away from the top portion in a direction opposite the open interior. The at least one target ring defines at least one target area configured to receive produce to be sliced. Third and fourth blade sets each include a first frame bar and a second frame bar. A plurality of blades extend between the first and second frame bars. The first and second blade sets are retained within the open interior of the second cover. The second pusher head is configured to removeably engage the head receiver of the frame. The second pusher head further includes a pusher head body and at least one produce pusher with a plurality of fins extending in a direction away from the pusher head body. The at least one produce pusher is aligned with the at least one target ring.

An exemplary blade cartridge for use in slicing produce includes a pusher head comprising a pusher head body and at least one produce pusher with a plurality of fins extending in a direction away from the pusher head body. A first handle extends from the pusher head body. A blade assembly includes a blade cover having a planer top portion and a plurality of sides extending away from the planar top portion. The planer top portion in the plurality of sides define an open interior. At least one target ring defines a target area configured to receive a piece of produce to be sliced. At least one blade set includes a first frame bar and a second frame bar with a plurality of blades extending therebetween. A second handle extends away from a side of the plurality of sides of the blade cover in a direction away from the open interior. The second handle corresponds with the first handle.

DETAILED DISCLOSURE

Figure 1:
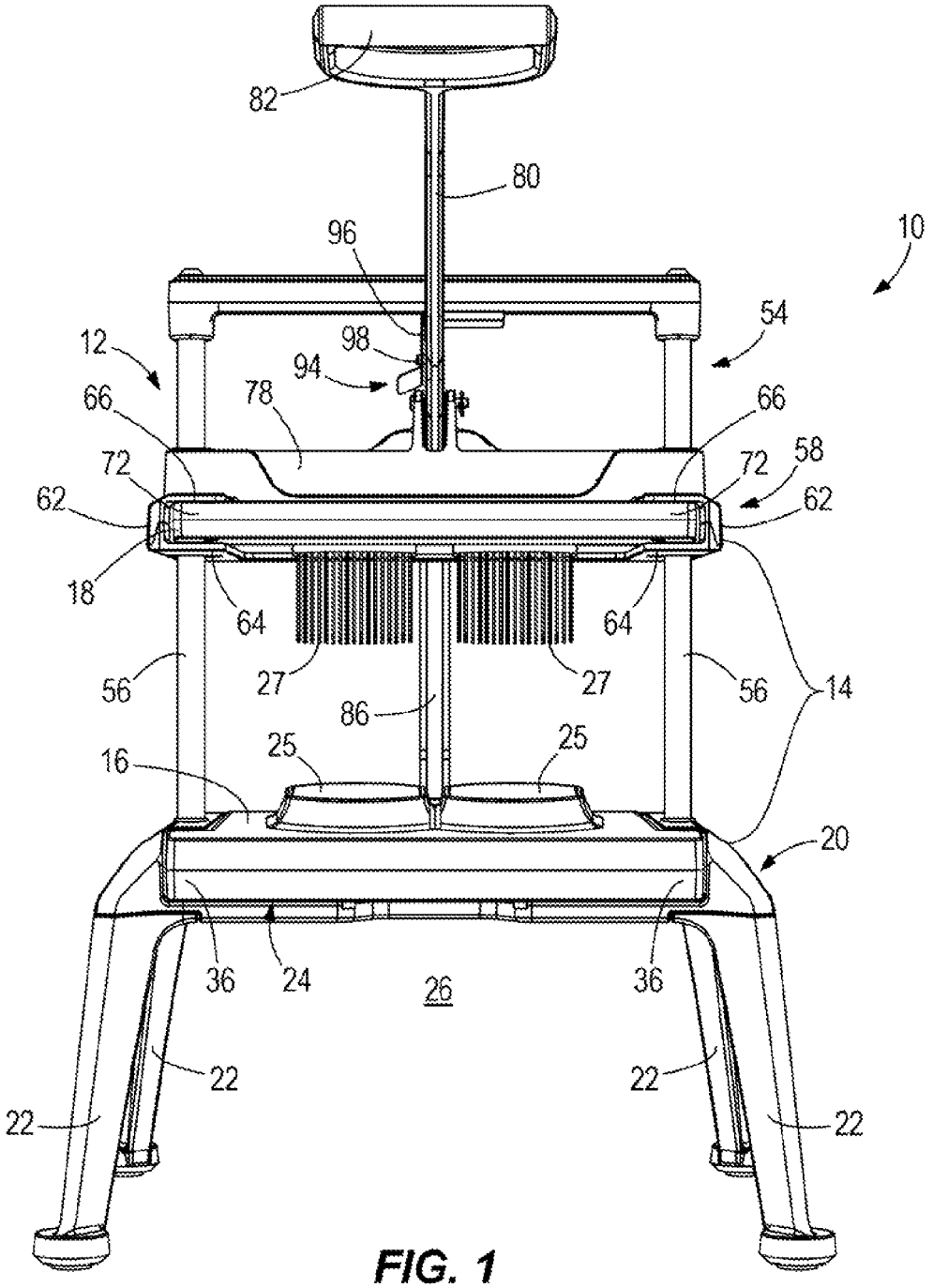
FIG. 1 is a front view of an exemplary embodiment of a slicing system.

FIG. 1 is an exemplary embodiment of a produce slicer 10. The produce slicer 10 includes a frame 12. A blade cartridge 14 is received within the frame 12. The blade cartridge 14 includes a blade assembly 16 and a pusher head 18. In an exemplary and non-limiting embodiment, the blade assembly 16 and the pusher head 18 of the blade cartridge 14 are slidingly received into the frame 12. The frame 12 facilitates movement of the pusher head 18 relative to the blade assembly 16 such that the pusher head 18 is partially received within the blade assembly 16. The frame 12 will be described in further detail herein, with respect to the perspective view of the frame 12 depicted in FIG. 2 and the produce slicer 10 depicted in FIG. 1. The produce slicer 10 as well as other embodiments as described herein may exemplarily be used to cut any of a variety of produce, including, but not limited to: fruits, vegetables, meats, seafood, tofu, cheese and other foods. While embodiments are exemplarily described in further detail herein with specific reference to tomatoes, onions, and lettuce, it will be recognized that the range of available foods to be cut are not so limited.

The frame 12 includes a frame base 20 which itself may include at least one leg 22. In an exemplary embodiment, the frame base 20 includes four legs, each extending from a corner of the frame base 20. In a still further exemplary embodiment, a width dimension W between adjacent legs 22 and a depth dimension D between adjacent legs 22 are both at least 13 inches apart such that standard size food preparation containers may be inserted below the frame 12 from any of the front, rear, right, and left sides. This facilitates flexibility in placement of the produce slicer 10 within the food preparation area of a kitchen as well as to promote flexibility in work flows within the produce preparation area by food preparation workers. In a still further embodiment, one or more lower support bars (not depicted) extend between adjacent legs 22. In use, these lower support bars help to stabilize the device in the event that one of the legs inadvertently slides off of the work surface.

The frame base 20 further includes a support surface 24. The support surface 24 as described in further detail herein supports the blade assembly 16. The base 20 therefore defines a product receiving area 26 between the legs 22 and below the support surface 24 wherein the aforementioned, but not depicted, produce receiving container may be positioned below the support surface 24 to receive the sliced produce after operation of the produce slicer 10. In an exemplary embodiment, the support surface 24 includes a front support 28, opposed lateral supports 30, and a rear support 32. In the exemplary embodiment depicted in FIG. 2, the support surface 24 includes all of the front supports 28, lateral supports 30, and rear supports 32 and such supports form a continuous support surface 24 around and above the produce receiving area 26. It will be recognized that in alternative embodiments, the front support 28, lateral supports 30, or rear support 32 may be separate components of the frame base 20, or that the support surface 24 may be implemented with more or fewer support areas as disclosed. In still further embodiments, the frame base may include other numbers of legs, including three-legged versions. In another embodiment, the frame base and or support surface may be a cantilevered construction, for example with base plate (not depicted) forming the product receiving area and the support surface cantilevered over the base plate. Such a construction facilitates open access to the product receiving area exemplarily from the front and sides. In a still further embodiment, the frame base may be constructed with no or limited legs and configured to be secured to or positioned over the produce receiving container.

The front support 28 further includes support cut-outs 34 which are configured to receive arms 36 of the blade assembly 16, as will be described in further detail herein. The base assembly 16 includes one or more target areas 25, as will be described in further detail herein. Additionally, embodiments of the front support 28 may include a finger cut-out 38 which facilitates insertion and removal of the blade assembly 16 with the frame 12. The finger cut-out 38 may exemplarily extend in a depth dimension as exemplarily depicted in FIG. 2 or in a height dimension as exemplarily depicted in FIG. 4. The inventors have discovered that in some embodiments, the cut-out 38 in the height dimension facilitates removal of the pusher head when the frame is in a down position. This facilitates simultaneous removal of the blade assembly and pusher head while engaging one another, further covering the blades of the blade assembly during removal.

In further exemplary embodiments, the rear support 32 includes one or more support structures 40, which define at least one elevated support surface 42.

As will be described in further detail herein, the frame base 20 is configured to receive, hold, and support the blade assembly 16. The frame base 20 further includes lateral walls 44 and a rear wall 46 that may extend vertically from the support surface 24. The lateral walls 44 and the rear walls 46, together with the support surface 24 and cut-outs 34, define a blade assembly receiving area 48. In an exemplary embodiment, front alignment structures 50 are located in the cut-outs 34 of the lateral walls 44. Rear alignment structures 52 are exemplarily located on outward faces 49 of the rear wall 46. In embodiments as will be described in further detail herein, the front alignment structures 50 and rear alignment structures 52 matingly engage alignment structures located on the blade assembly 16 as will be described in further detail herein in order to align and secure the blade assembly 16 in the blade assembly receiving area 48. In an exemplary embodiment, the front alignment structures 50 are bodies (e.g. pins) that project from the outward faces 49 of respective lateral walls 44, and the rear alignment structures 52 are bodies (e.g. pins) that project from the rear wall 46. The front alignment structures 50 and the rear alignment structures 52 are matingly received by corresponding alignment holes located in the blade assembly 16 and described in further detail herein. It will be recognized by a person of ordinary skill in the art that a variety of other alignment structures may be used, including, the reverse of the embodiment depicted (e.g. alignment holes in the outer faces 49 of lateral walls 44 and rear wall 46) or other geometric shapes of mating structures.

The frame 12 further includes a pusher assembly 54 at least partially movably secured to the frame base 20. The pusher assembly 54 includes rails 56 which extend from the frame base 20. The pusher assembly 54 further includes a head receiver 58. The head receiver 58 is exemplarily slidingly secured to the rails 56 and is configured as described in further detail herein to receive a pusher head 18 of a blade cartridge 14. The head receiver 58 includes laterally opposed guide arms 60 and a rear guide 62. The guide arms 60 and rear guide 62 include lower plates 64 and upper plates 66. The lower plates 64 and upper plates 66 of the guide arms 60 and rear guide 62 define a pusher head receiving area 68 configured to receive a pusher head 18, and is exemplarily configured to slidingly receive a pusher head 18. The pusher head 18 is configured with one or more pushers 27 that correspond to a target area 25 of the blade assembly 16. The head receiver 58 may further include one or more holes 53 which are configured to receive a respective one or more pin (not depicted) to secure through corresponding holes (e.g. 135 in FIGS. 7-8) through the pusher head 18. The pins therefore may further facilitate to secure the pusher head 18 within the head receiver 58. A similar construction may also be used to secure the blade assembly 16 within the blade assembly receiving area 48.

The guide arms 60 further include cut-outs 70 that are configured to receive respective arms 72 of the pusher head 18. The head receiver 58 further includes front alignment structures 74 located on the guide arms 60, and particularly exemplarily in the cut-outs 70 of the guide arms 60, as well as rear alignment structures 52 located in the rear guide 62 exemplarily between the lower plates 64 and the upper plates 66 of the rear guide 62. The front alignment structures 74 and rear alignment structures 76 are configured to matingly engage corresponding alignment structures as disclosed in further detail herein located on the pusher head 18 in order to facilitate alignment and engagement between the pusher head 18 and the head receiver 58. It will be recognized that the alignment structures 74 and 76 of the head receiver 58 are corresponding alignment structures of the pusher head 18 may exemplarily be the same as or in accordance with the disclosure above regarding the alignment structures 50 and 52 of the frame base 20 and alignment structures of the blade assembly 16.

The head receiver 58 further includes a force bar 78 that extends between the laterally opposed guide arms 60. The force bar 78 operates to translate force from an arm 80 connected to a handle 82 which movably engages the force bar 78. In an exemplary embodiment, the arm 80 has an inverted "L" shape to generally orient the handle 82 in a horizontal orientation, while it will be recognized that other orientations may be used including a more vertical arm 80, resulting in a vertically-oriented handle 82. In the exemplary embodiment depicted in FIGS. 1 and 2, the arm 80 is pivotably secured to the force bar 78 at an arm pivot 84. The arm pivot 84 translates generally downward force applied to the handle 82 by a user to the force bar 78 to direct the head receiver 58 downward towards the frame base 20 during operation of the produce slicer 10. In an exemplary embodiment, the arm 80 is further secured to a body 86 by a body pivot 88 and the body 86 is secured to the base 20 at a base pivot 90. The pivoted connection of the body 86 between the base 20 at the base pivot 90 and the arm 80 at the body pivot 88 reduces the overall operable footprint of the device such that the arm 80, body 86, or body pivot 88 do not extend laterally past the rear leg 22 of the base 20. In exemplary embodiments, this enables the produce slicer 10 to be positioned with the rear legs 22 engaging a wall or kitchen station divider enabling efficient use of workstation counter space. Embodiments of the combination of arm 80, arm pivot 84, body 86, body pivot 88, and base pivot 90 further limit the extent to which the handle 82 extends beyond the lateral dimension of the front legs 22 during operation of the produce slicer 10 and such that embodiments of the produce slicer 10 may be operated by a food preparation worker with minimized impact to the movement of other workers past the worker operating the produce slicer.

Embodiments of the frame 12 further include a rail crossbar 92 which extends between the laterally opposed rails 56. At least a portion of a latch 94 extends from the rail crossbar 92. The latch 94 may include a detent portion 96 which extends from the rail crossbar 92 and an engagement portion 98, which extends from the arm 80. However, it will be recognized by a person of ordinary skill in the art that the latch 94 as disclosed herein may be carried out through alternative implementations. These alternatives may include a reversal of the detent and engagement portions, or other releaseably engageable configurations of corresponding structures. In the embodiment depicted, the detent portion 96 comprises a metal plate which includes a receiving portion or at least one cut-out that receives the engagement portion 98. The plate of the detent portion 96 is configured to be deformable away from the arm 80 and engagement portion 98, such that the engagement portion 98 moves past a front end of the detent portion 96 before engaging in the cut-out portion. In operation, this creates a passively automated latch that is biased to secure the head receiver 58 in the open or "up" position. In a still further embodiment, this operates as a safety mechanism as it creates a two-handed operation of the produce slicer, such that the food preparation worker must place one hand on the rail crossbar 92 in order to release the latching mechanism 94, exemplarily with the worker's thumb, while the worker operates the handle 82 with the worker's other hand to slice the produce. This creates a mechanical safety feature whereby the worker removes both hands from the cutting area before operating the produce slicer, promoting worker safety.

Figure 2:
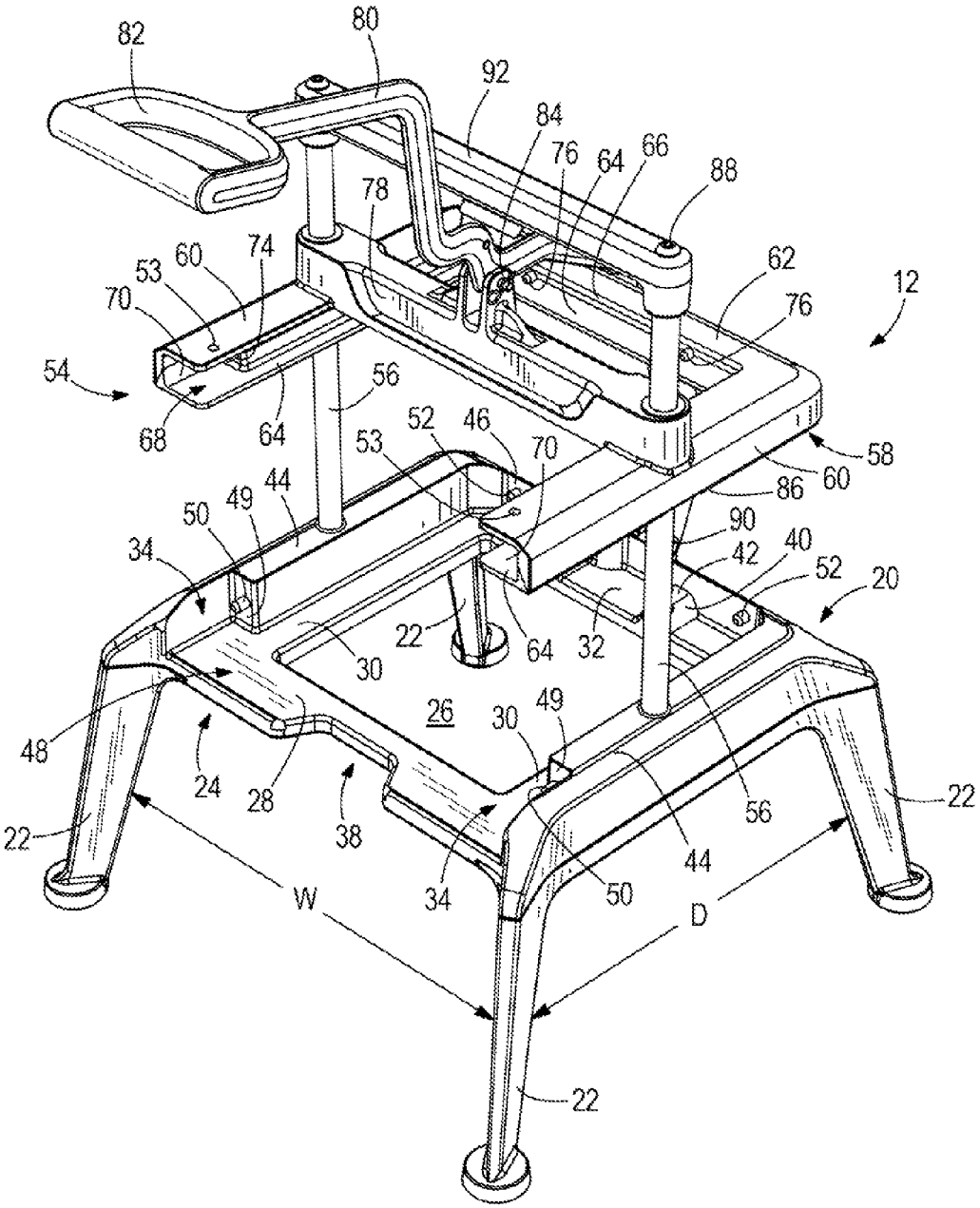
FIG. 2 is a perspective view of an exemplary embodiment of a frame for a slicing system.
Figure 3:
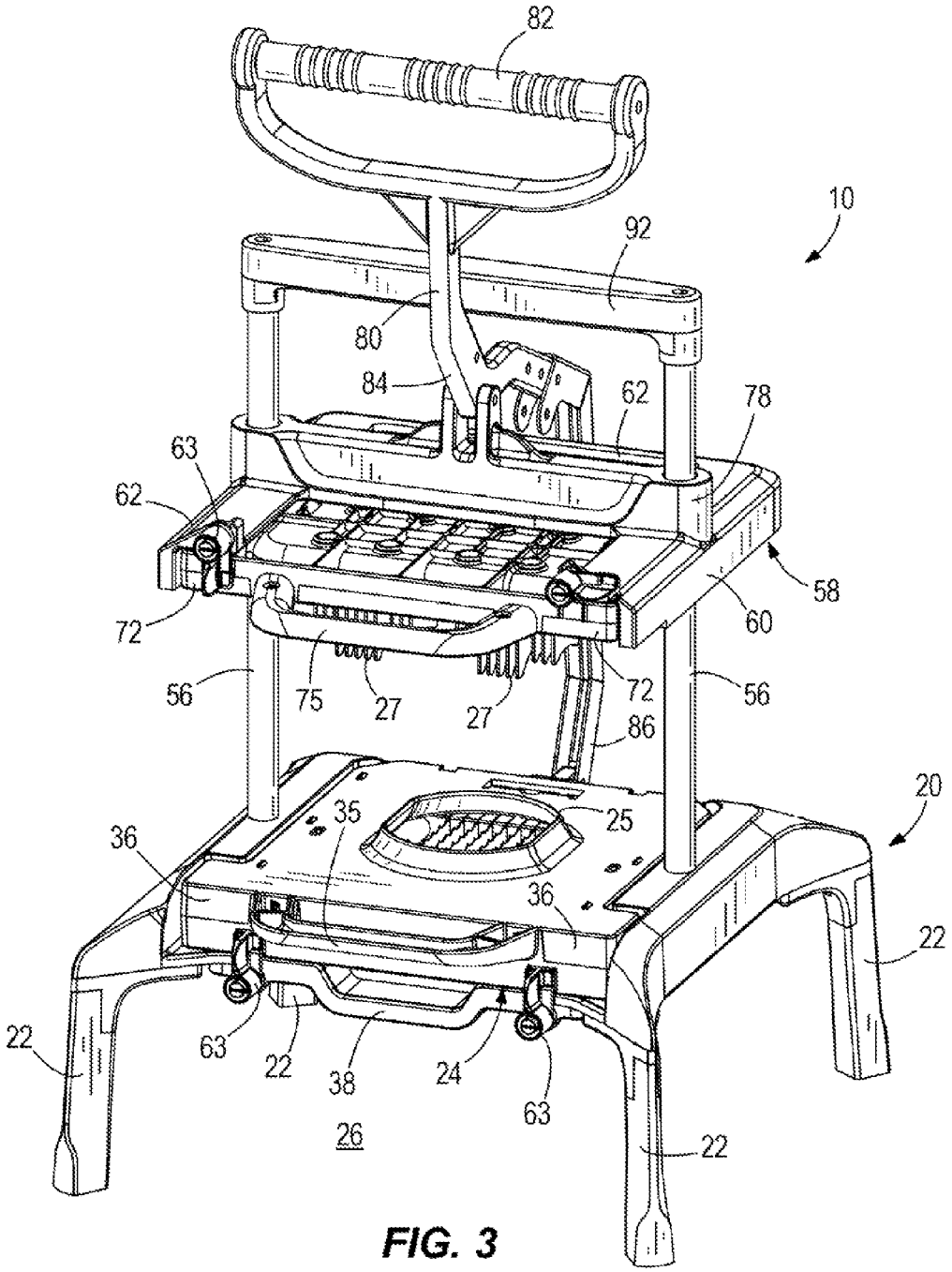
FIG. 3 is a perspective view of an additional exemplary embodiment of a slicing system.
Figure 4:
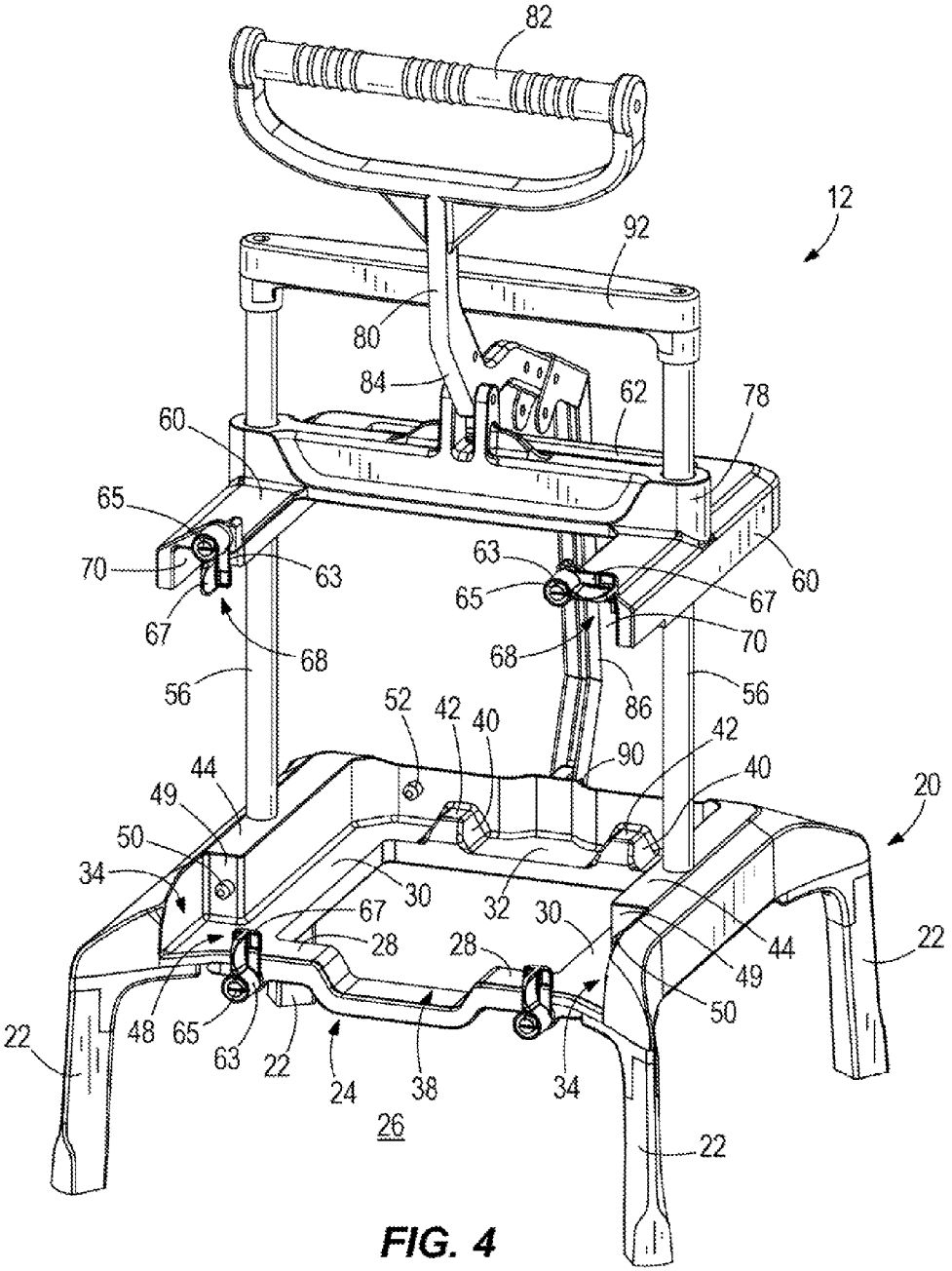
FIG. 4 is a perspective view of an additional embodiment of a frame.

FIGS. 3 and 4 depict an additional configuration of the produce slicer 10. It will be recognized that FIGS. 3 and 4 use similar reference numbers as the description above with respect to FIGS. 1 and 2. This exemplarily indicates similar structures and the description thereof with respect to any of FIGS. 1-4 may similarly apply in various combinations and embodiments. It is understood by a person of ordinary skill in the art that additional combinations of the features disclosed herein apart from the specific exemplary embodiments depicted in the drawings are contemplated within the scope of the present disclosure. The produce slicer 10 includes a frame 12, exemplarily described above. A blade assembly 16 is exemplarily received in the frame 12. A pusher head 18 is exemplarily received within the frame 12. Embodiments of the blade assembly 16 and pusher head 18 may include many features as described herein with respect to embodiments of the blade assembly and pusher head. Embodiments of the produce slicer 10 may further include additional features as will be described in detail herein.

The produce slicer 10 exemplarily includes at least one lock 63 configured to secure the blade assembly 16 to the frame 12. The produce slicer 10 further includes at least one lock 63 configured to secure the pusher head 18 to the frame 12.

In embodiments, the at least one lock 63 may be a plurality of rotational locks pivotably secured to the frame 12. Such locks 63 may include a pivot pin 65 and a rotating arm 67 secured by the pivot pin 65 to the frame 12. Exemplary embodiments of the at least one lock 63 may be manually actionable, such that a worker using a produce slicer 10 manually operates the at least one lock 63 between a first position extending across at least a portion of the blade assembly 16 and/or pusher head 18 and a second position where the blade assembly 16 and/or pusher head 18 is moveable with respect to the frame 12. The second position of the at least one lock 63 opens the frame 12 to receive or remove the respective blade assembly 16 and/or pusher head 18. The first position of the at least one lock 63 secures the blade assembly 16 and/or pusher head 18 to the frame 12 after installation of the respective blade assembly 16 and/or pusher head 18 into the frame 12. In still further embodiments, the at least one lock 63 may be used in addition to or in connection with the alignment structures, as previously described, which may be located on both the frame 12 and a respective blade assembly 16 or pusher head 18. In one exemplary embodiment, one or more of the locks 63 are positioned on the frame such as to be in alignment with the respective arms 36 of the blade assembly 16 and/or the arms 72 of the pusher head 18. In another embodiment, the at least one lock 63 is aligned with another portion of the respective blade assembly 16 and/or pusher head 18. Exemplarily, the at least one lock 63 is aligned interior of the arms 36 of arms 72. It will be recognized that other implementations of locks may be used in additional embodiments including, but not limited to latches, clasps, and mated configurations.

FIG. 4 is a perspective view of an additional configuration of the frame 12. FIG. 4 exemplarily further depicts the at least one lock 63. As will be seen from FIG. 4, an embodiment of the frame 12 may include four locks 63, exemplarily one lock 63 associated with each lateral side of a respective blade assembly 16 and pusher head 18. The finger cutout 38 as shown in FIGS. 3 and 4 exemplarily extends in the vertical dimension in contrast to the finger cut-out 38 shown in FIGS. 1 and 2 which extends in the horizontal dimension. It will be recognized that other configurations of finger cut-outs 38 may also be used as previously described.

The produce slicer 10 depicted in FIGS. 3 and 4 further includes a blade assembly 16 with a handle 35 and a pusher head 18 with a handle 75. The respective handles 35, 75 will be described in further detail herein, but it is to be recognized that they facilitate insertion, removal, and transport of the pusher head 18 and blade assembly 16 by a user while keeping the user's hands and fingers away from the blades (described herein) of the blade assembly 16. In an exemplary embodiment, as depicted, the handle 35 of the blade assembly 16 and the handle 75 of the pusher head are exemplarily "D" shaped in cross section such that flat portions of the respective handles 35, 75 correspondingly engage or align to facilitate grasping both handles with one hand.

As best seen in FIG. 4, in exemplary embodiments, the frame 12 may be configured without lower plates 64 (FIG. 2). In such an embodiment, the elimination of the lower plates facilitates access for placing and removing the pusher head 18 (FIG. 3). In such embodiments, the placing/removing motion becomes more similar to that of the blade assembly 16 (FIG. 3) whereby both pusher head 18 and the blade assembly may be placed or removed with an angled motion. In such an embodiment, the pusher head 18 (FIG. 3) is retained within the frame 12 by the engagement of the alignment structures 74, 76 with the pusher head 18 and engagement of the lock 63 within the pusher head 18. However, it will be understood that the frame as depicted in FIG. 4, may alternatively be constructed to include the lower plates 64 as depicted in FIG. 2 without departing from the scope of the present disclosure.

In another embodiment, the blade assembly 16 and the pusher head 18 nestingly engage each other, exemplarily by receiving the pushers(s) of the pusher head within the target ring(s) of the blade assembly. The handles 35, 75 of each of the blade assembly 16 and the pusher head 18 generally correspond to facilitate grasping and handling of both parts of the entire blade cartridge 14 as a single unit. The frame 12 may be configured, exemplarily as described above, such that when the frame and handle are moved into the lower position, the blade cartridge 14 including the blade assembly 16 and the pusher head may be inserted into the frame 12 as a single unit. Exemplarily, the blade assembly 16 and the pusher head 18 will engage the respective alignment structures and locks 63 moved into position to secure the blade assembly 16 and the pusher head 18 to the frame 12 before raising the handle to the raised position.

Figure 5:
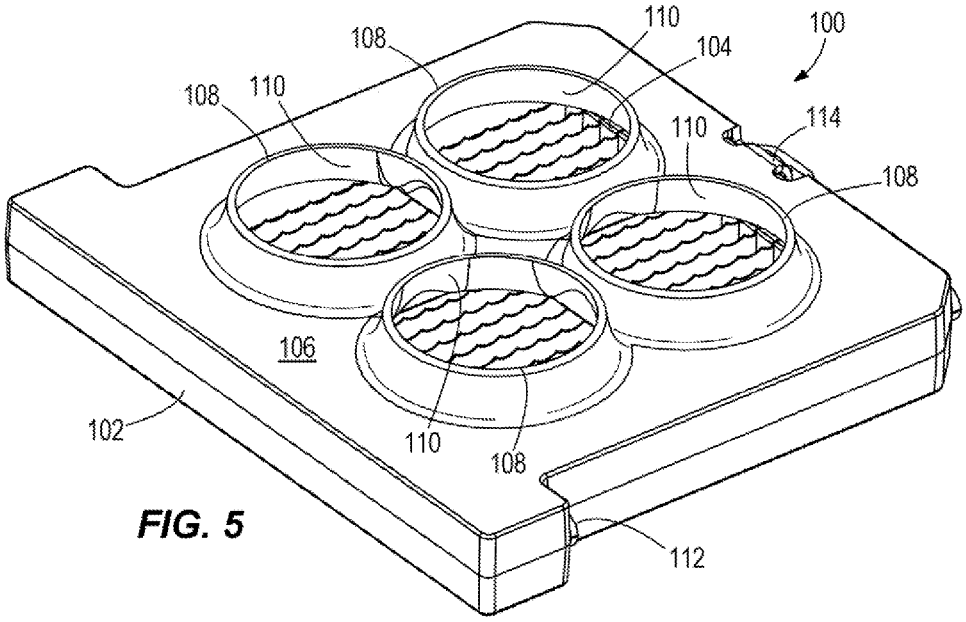
FIG. 5 is a perspective top view of a first embodiment of a blade assembly.

FIG. 5 depicts an exemplary embodiment of a blade assembly 100 which may be used in conjunction with a frame 12 in a produce slicer 10. The blade assembly 100 includes a blade cover 102 and at least one blade set 104, both of which will be described in further detail herein. The blade assembly 100 is exemplarily configured to slice soft produce quickly. The embodiment of the blade assembly 100 depicted in FIG. 3 is exemplarily configured to slice four tomatoes or cucumbers. Various embodiments of blade assemblies 100 may be configured to receive different types of produce within the produce slicer 10. As will be described in further detail, the blade cover 102 includes multiple features that facilitate operation of embodiments of the produce slicer. The blade cover 102 includes a top portion 106 which is generally flat and extends across at least a portion of the at least one blade set 104 contained within the blade cover 102. The top portion 106 includes at least one target ring 108. In an embodiment, at least one of the target rings 108 extend upward from the top portion 106. In embodiments, the target rings 108 define a target area relative to the blades within which the produce is placed. The target rings therefore may define the target area without extending upward from the blade cover 102. In the exemplary embodiment depicted in FIG. 3, four target rings 108 extend from the top portion 106 to facilitate slicing of four tomatoes (or other produce) during a single actuation of the produce slicer 10.

The target rings 108 serve multiple functions. First, the target rings 108 generally define the shape of the produce to be sliced by the blade assembly 100. This limits the exposed portions of the blade set 104 to only the area of the blades needed to slice the produce. Additionally, the target ring 108 may extend vertically upward from the top portion 106 such as to further define a retaining lip 110 that holds the produce in place in the blade assembly 100. This retaining lip 110 helps to maintain alignment of the produce with the underlying at least one blade set 104. In addition to speed of slicing the produce, accuracy in slicing produce is also desirable as food preparation and restaurant standards often require that the produce be sliced in a particular orientation relative to the physical structure of the produce itself. Therefore, it is desirable for the produce to be sliced to be held in a position relative to the blade set between placement and slicing of the produce with the produce slicer 10. In still further embodiments, the target ring 108 may further facilitate this orientation of the produce relative to the at least one blade set by corresponding the shape of the target ring to any generalized features of the shape of the produce to be sliced when placed in the desired orientation.

In an embodiment, the retaining lip 110 defines a distance above the top portion 106 which a corresponding portion of the pusher head, as will be disclosed in further detail herein, cannot engage thereby defining a gap generally between components of the blade assembly 100 and the pusher head when the pusher head is in the closed position. In an embodiment, if an operator's fingers are positioned on the top portion 106 when the pusher assembly 54 is lowered to the closed or lowered position, the worker's fingers will not be pinched between the components of the blade assembly 100 and the pusher head. In another embodiment, the pusher head is configured such that the blade assembly 100 and pusher head nestingly engage to minimize storage space required for the whole blade cartridge.

In a still further function, the target rings 108, and the retaining lip 110 further protect fingers of workers when inserting food into the target ring 108 by creating a still further barrier between fingers and the blades within the blade cover. In use, the worker must release the food before the retaining lip 110.

The blade cover 102 further includes alignment structures 112 which are configured to matingly engage the exemplary front and/or rear alignment structures found on the frame base and the pusher assembly. Embodiments of the blade cover 102 further include a resilient finger 114 which can facilitate connection and removal of the at least one blade set 104 to the blade cover 102.

Figure 6:
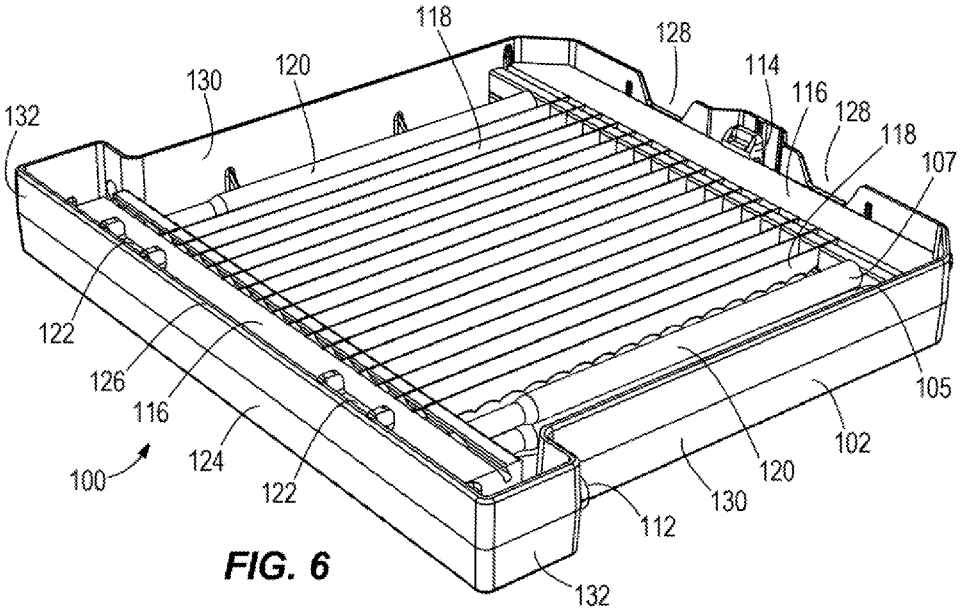
FIG. 6 is a perspective bottom view of the first embodiment of the blade assembly.

FIG. 6 is a bottom perspective view of an exemplary embodiment of the blade assembly 100 as depicted in FIG. 5. From the bottom view of the blade assembly 100 depicted in FIG. 4, two blade sets 104 can be seen stacked upon one another within the blade cover 102. In other embodiments of the blade assembly, other numbers of blade sets, including but not limited to one blade set or three blade sets, may be used. In an exemplary embodiment, the blade set 104 includes two opposed frame bars 116 across which a plurality of blades 118 are secured. In exemplary embodiments. In embodiments, the frame bars may be constructed as extrusions, cast, machined, or milled. It will be recognized that other manufacturing techniques may be used while remaining within the scope of the present disclosure. While the blade set 104 is depicted with two frame bars 116, it is understood that more or fewer frame bars may be used in embodiments. In an embodiment the two or more frame bars may be portions of a continuous structure such as a frame. In embodiments such a frame may be milled from a single piece of material or cast as a unitary structure. In a still further embodiment, the frame bars may be portions of a ring, oval, rectangular, square, or other shaped frame within which the blades are secured. In still further embodiments as described herein, the frame bars may be constructed of multiple pieces secured together and secured to the blades.

The blades 118 are may be serrated in order to reduce the surface area of the blades that engage the produce at any one time, exemplarily such as to be able to cut through the tough skin of a tomato as compared to a head of lettuce, or the meat of the tomato. It will be recognized that other types of blades may be used as well. One or more tensioning rods 120 extend between the opposed frame bars 116. Embodiments of the tensioning rods 120 may include a tensioning screw (not depicted), which is operated in order to achieve a desired tension on the plurality of blades 118. It will be noted from the embodiments depicted in FIGS. 6 and 9, the blades 118 of the two blade sets 104 are offset from one another. It will be recognized that the distance between adjacent offset blades corresponds to a desired thickness of the sliced produce, while offsetting of the blades further reduces the surface area engaged by the skin or surface of the produce at one time which promotes produce slicing. Still further embodiments may use a variety of other blade sets and include a blade cover 102 configured in the manners as disclosed herein to receive those other blade sets. Non-limiting exemplary embodiments of other blade sets which may be used include the 908, 910, 912, 925, and 943 series of blade sets all currently available from Prince Castle LLC.

As previously disclosed, in an embodiment, two blade sets 104 are secured within the blade cover 102. In an embodiment, the blade sets 104 are secured within the open interior of the blade cover 102 defined by the top portion 106 and the sides 130. The two blade sets 104 are exemplarily a top blade set 105 and a bottom blade set 107. In an embodiment, one or more support ledges 122 extend from the interior of the front side 124 of the blade cover 102. The front side 124 terminates in a front lip 126. The support ledges 122 engage a bottom blade set 107 of the at least one blade set at the front end of the blade cover 102 and the aforementioned finger 114 extending from the rear end of the blade cover 102 engages the bottom blade set 107 at the rear end of the blade assembly 100. Therefore, the combination of the support ledges 122 and the finger 114 hold the at least one blade set 104 within the blade cover 102 to form the blade assembly 100. In an embodiment as depicted that uses two or more blade sets, the support ledges 122 and finger 114 are located such that engagement between the support ledges 122, finger 114, and bottom blade set 107, also retains the top blade set 105 within the blade cover 102.

In other embodiments, the blade sets may be secured within the blade cover in a variety of other ways. One or more cross-pins may extend along the bottom of the blade cover below the blade sets to retain the blade sets within the cover. Fasteners, including screws, pins, or rivets may extend through the sides of the blade cover into one or more of the blade sets, exemplarily into the frame bars. Fasteners may extend into one or more of the blade sets through the top surface of the blade cover. In one exemplary embodiment, the blade cover may include limited or no side walls and the planar top portion of the blade cover is secured to the blade sets. The blade cover may extend at least partially around the blade sets by including a bottom side opposite the top surface. In a modified embodiment, the blade cover may at least partially surround the blade sets on top, bottom, and sides, and the blade cover comprises at least two pieces that may be secured to one another to locate and retain the blade sets therein. In a still further embodiment, the blade cover may be independently fixable to the frame from one or more blade set.

In use, when the blade assembly 100 is inserted into the blade assembly receiving area 48 of the frame 12, the support ledges 122 engage the front support 28 such that the slicing force against the at least one blade set 104 is transferred through the support ledges 122 to the front support 28 of the support surface 24. The blade cover 102 further includes cut-outs 128 that are configured such that support structure 40 can pass through the wall of the blade cover 102 at the rear of the blade cover 102 and the elevated support surfaces 42 of the support structures 40 directly engage the bottom blade set 107. Thus, the blade set, which must resist the slicing force placed on the blade set through the produce and the pusher head are supported by the support surface of the frame 12.

Embodiments of the blade assembly 100 further facilitate worker safety as the blade cover defines spaces for the worker to grab and hold the blade assembly 100 when placing and removing the blade assembly from the produce slicer. For example, the worker can grip over the front lip 126 and the worker's fingers will touch either the frame bar 116 or the non-cutting side of the blades 118. The worker may also grip the blade assembly 100 from the blade cover sides 130 where the worker's fingers will engage a space between the sides 130 and the tension rods 120 therefore away from the blades 118. Still further, the worker may grip the arm 132 of the blade assembly, where the worker may either grip the arms 132 of the blade cover 102 or within a region interior to the arms 132 between the sides 130 and the frame bar 116. In each of these cases, the worker's fingers are naturally located at positions removed from the blade and the cutting surfaces of the blades 118 are interior to the blade assembly 100 and away from general access by the worker.

Figure 7:
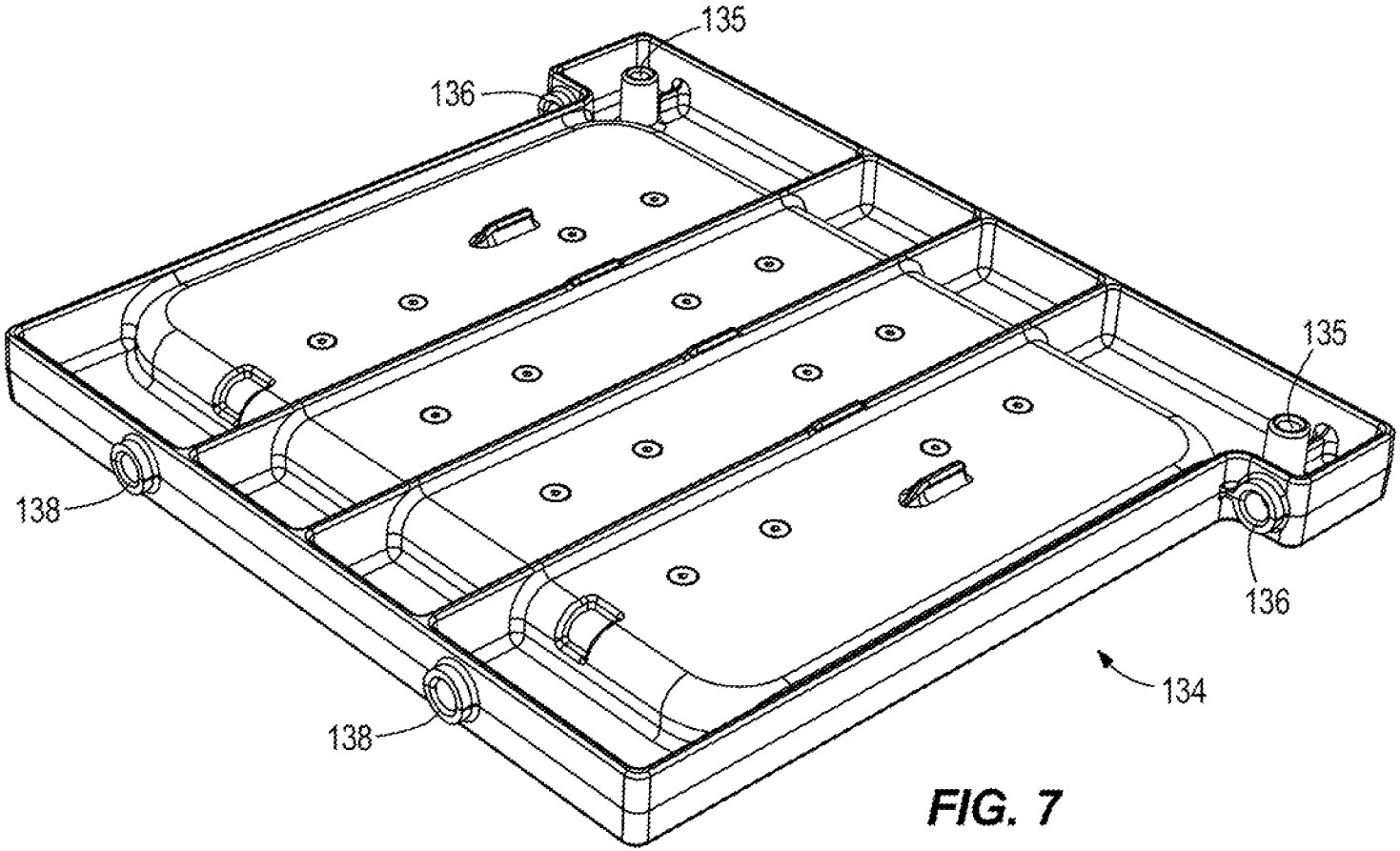
FIG. 7 is a perspective top view of a first embodiment of a pusher head.

FIG. 7 depicts an exemplary top perspective view of a pusher head 134 as will be received within the pusher head receiving area 68 of the frame 12. The pusher head 134 exemplarily includes front alignment structures 136 and rear alignment structures 138 which are configured to engage and secure to the front alignment structures 74 and rear alignment structures 76 of the head receiver 58.

Figure 8:
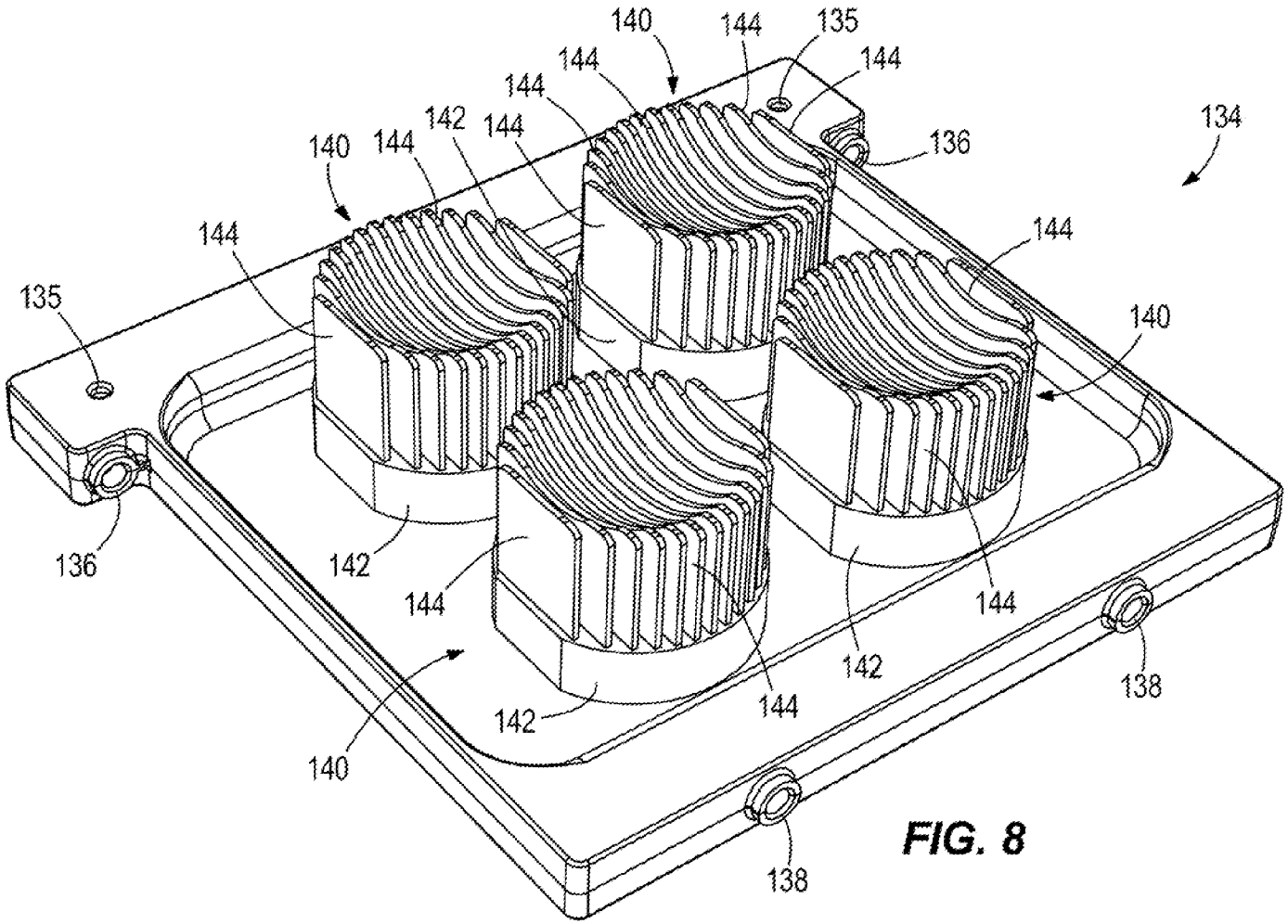
FIG. 8 is a bottom perspective view of the first embodiment of the pusher head.

FIG. 8 depicts an exemplary bottom perspective view of the pusher head 134 which is exemplarily configured for operation with the blade assembly 100 as depicted in FIGS. 5 and 6. Exemplarily, the pusher head 134 is configured for use in slicing multiple pieces of soft produce, for example, but not limited to, four tomatoes or cucumbers, and in the embodiment depicted, slicing four tomatoes simultaneously by actuation of the pusher assembly 54 of the produce slicer 10. The pusher head 134 therefore exemplarily includes four produce pushers 140. Each produce pusher 140 includes a base 142 from which extends a plurality of fins 144 a few of which are exemplarily labeled in FIG. 8 for identification purposes, although it will be recognized that far more fins 144 exist in the embodiment depicted in FIG. 6 than are specifically labeled with reference numbers. In an exemplary embodiment, the fins 144 are exemplarily constructed of aluminum or stainless steel and the bases 142 are injection molded around the fins 144. This contour serves to create the produce pushers 140. It will be recognized that the fins 144 are exemplarily contoured such as to generally define the shape of the surface of the produce to which the fins 144 will engage in order to maximize the distribution of the slicing force applied to the top of the produce when the pusher assembly 54 including the pusher head 134 is lowered against produce held in the target rings 108 of the blade assembly 100. It will be recognized that in the embodiment depicted, the contours are exemplarily in two dimensions, width and depth to form a bowl or dish shaped contour. It will be recognized that the fins 144 are positioned and oriented such that each of the fins 144 will pass through a respective target ring 108 and between adjacent blades in the blade assembly 100. It will further be recognized that in an embodiment wherein two or more blade sets 104 are used in the blade assembly 100, that the adjacent blades may be comprised of blades from two different blade sets in the blade assembly 100.

Figure 9:
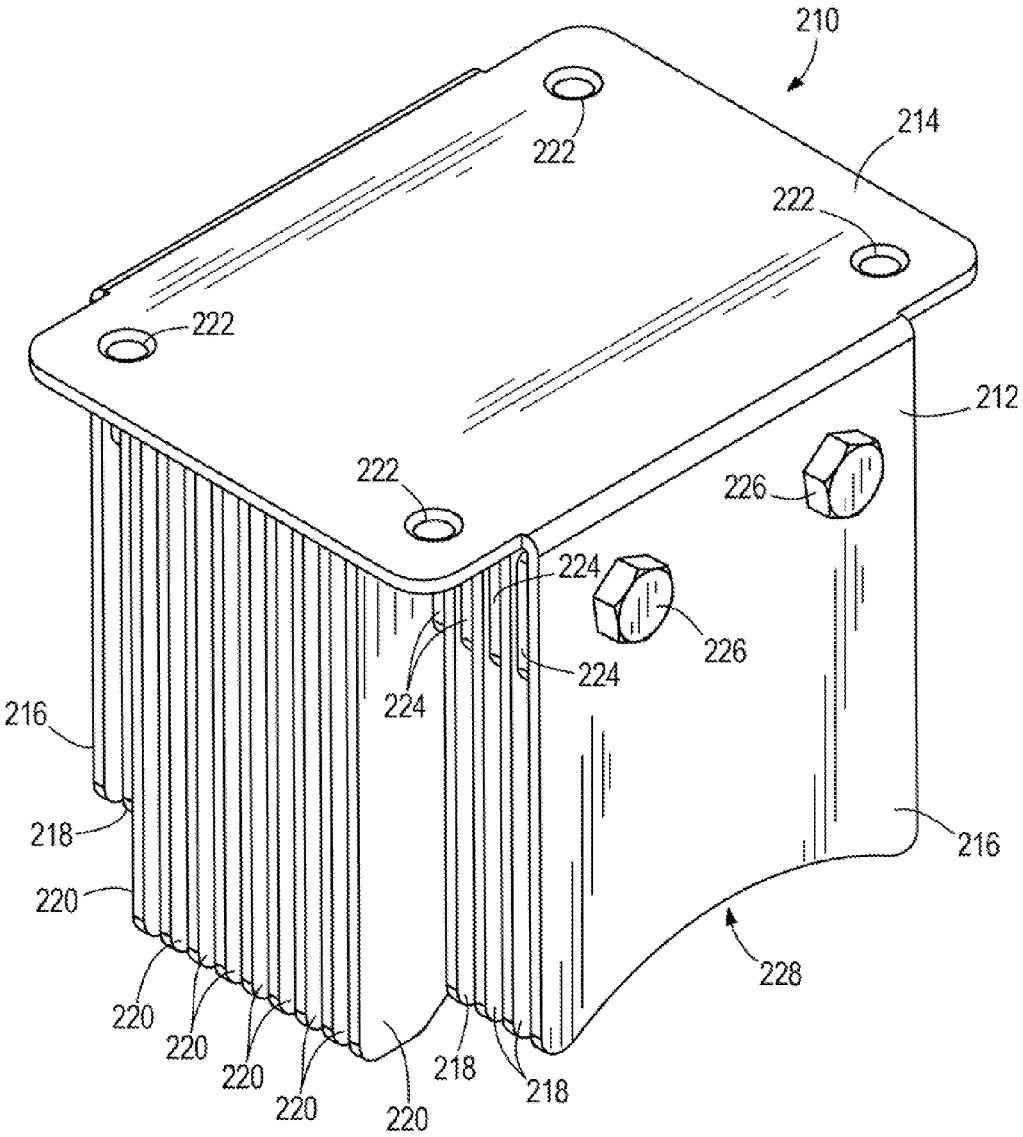
FIG. 9 is a perspective view of an additional exemplary embodiment of a produce pusher.
Figure 10:
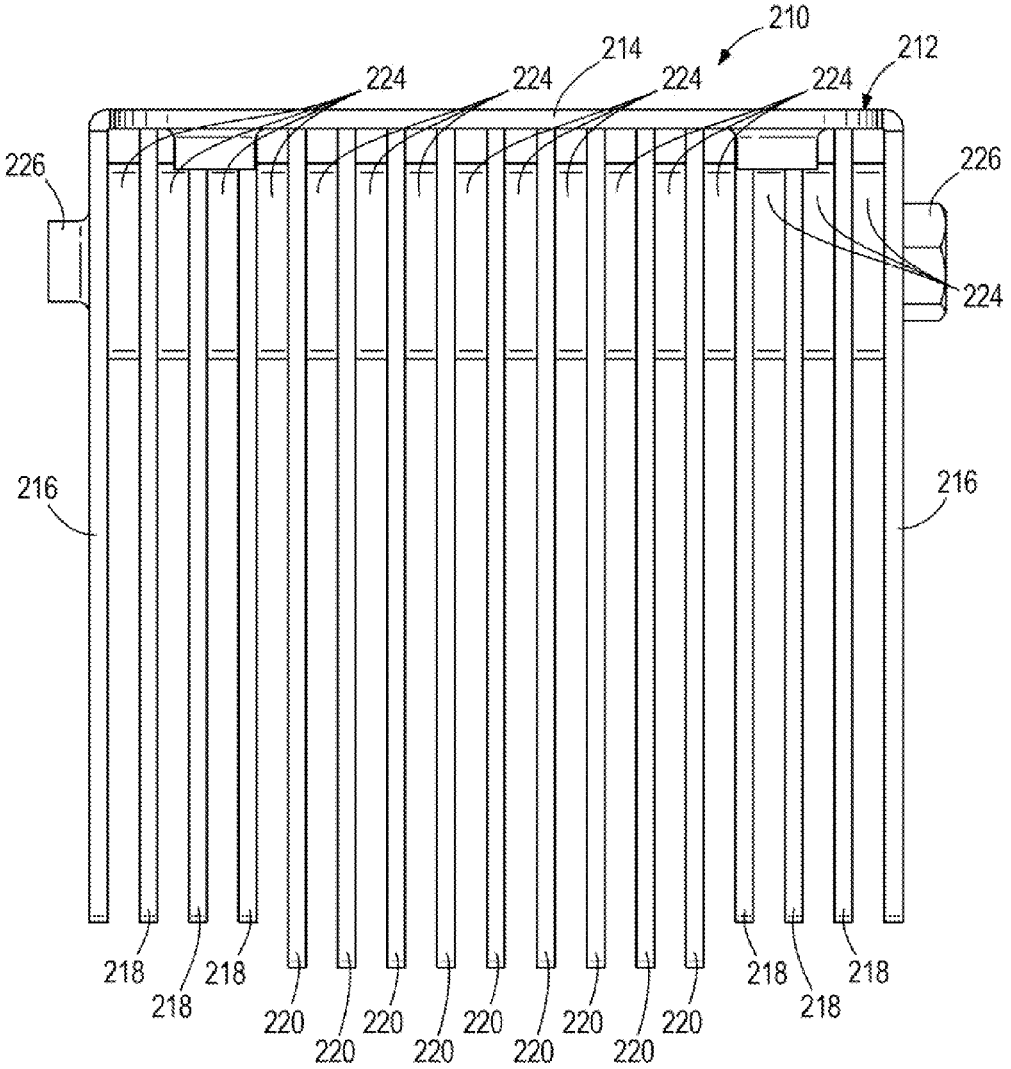
FIG. 10 is a front view of the additional exemplary embodiment of the produce pusher.
Figure 11:
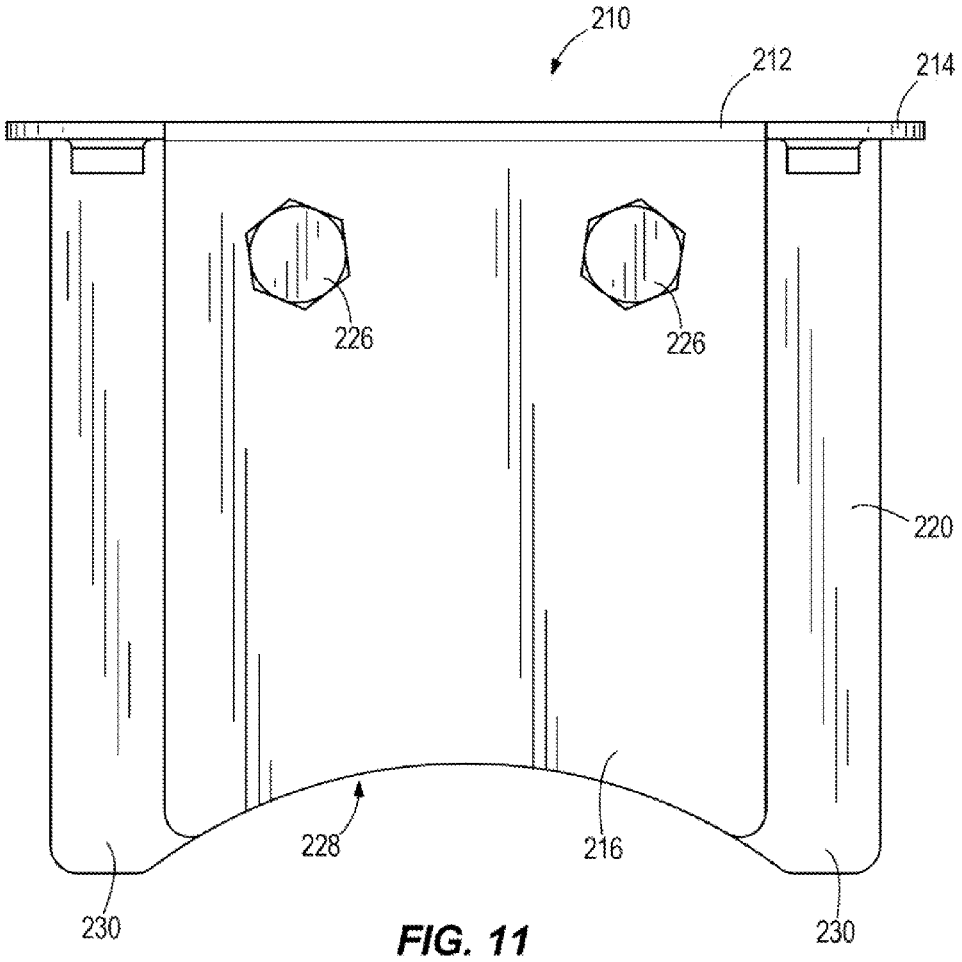
FIG. 11 is a side view of the additional exemplary embodiment of the produce pusher.

FIGS. 9-11 depict an additional exemplary embodiment of a produce pusher 210. FIG. 9 is a perspective view of the produce pusher 210. FIG. 10 is a front view of the produce pusher 210. FIG. 11 is a side view of the produce pusher 210. The produce pusher 210 may exemplarily be secured to the previously described pusher head 134.

The produce pusher 210 can include a generally U-shaped frame 212 and the U-shaped frame 212 is constructed of a base plate 214 which is configured to be secured to the pusher head and a pair of opposed side fins 216 extending from the base plate 214. The U-shaped frame 212 is exemplarily unitary in construction. The side fins 216 exemplarily provide the outer most fins (218, 220) of the produce pusher 210, as previously described above. As best depicted in the front view of FIG. 10, the side fins 216 form the outermost fins of the produce pusher 210 and a plurality of intermediate fins, (218, 220) are secured between the two opposed side fins 216. In an exemplary embodiment, the intermediate fins (218, 220) include intermediate end fins 218 and intermediate center fins 220. However, it will recognized that in other embodiments, the intermediate fins (218, 220) may all be of a similar construction or in still further embodiments, that still further different types of intermediate fins may be used.

In the exemplary embodiment of the produce pusher 210, the intermediate center fins 220 exemplarily extend wider and longer than the intermediate end fins 218. In some embodiments, this may be a practical distinction as described in further detail herein. In still other embodiments the additional length and width of the intermediate center fins 220 promote centering and alignment of the produce pusher 210 on a piece of produce placed in the produce slicer for cutting.

As best depicted in FIG. 11, the fins (216, 218, 220) may include a contour or depression 228 further configured to generally match a contour of an outer surface of a specific type of produce to be cut using the produce pusher 210. Such a contour 228 further promotes even application of cutting force by the produce pusher 210 to the piece of produce by increasing the surface area of each of the fins in contact with the piece of produce to be cut. It will be noted that the contour 228 is in a single dimension, exemplarily the same (depth) dimension within which the fins (216, 218, 220) and the blades (not depicted) extend. This contour 228, along with the elongated portions 230 of the intermediate center fins 220 helps to maintain positioning of the produce in this dimension, which facilitates cutting of the produce.

In an embodiment, the base plate 214 includes through holes 222 configured to receive at least one fastener (not depicted), which may exemplarily be a bolt, rivet, screw, or other type of fastener to secure the produce pusher 210 to the pusher head 134. In an exemplary embodiment, a difference in dimensions between the intermediate end fin 218 and the intermediate center fins 220 provide a space or region about the through holes 222 to promote access thereto for assembly and/or disassembly of the pusher head 134.

As best seen depicted in FIG. 10, a plurality of spacers 224 are located exemplarily between each of the fins (216, 218, 220). Exemplarily, the spacers 224 may be of an elastomeric or plastic construction although other polymers, exemplarily including, although not limited to nylon may be used. The spacers 224 define the distance between each of the respective fins (216, 218, 220). Each of the fins are associated with one slice of the produce cut by the produce slicer. As described above, a blade of the blade assembly 202 will correspondingly pass between each of the fins of the produce pusher 210 as the piece of produce is pushed by the produce pusher 210 through the blades of the blade assembly 202. The produce pusher 210 is exemplarily constructed by at least one fastener 226, exemplarily one or more bolts 226. The bolts 226 extend through corresponding holes (not depicted) in the side fins 216, intermediate end fins 218, intermediate center fins 220, and spacers 224 before the fastener 226 is tightened against the spacers 224 to secure the assembly of the produce pusher 210 together.

As previously described, embodiments of produce pushers 210 may include fins constructed of stainless steel; however, it will recognized that, while strong and durable, stainless steel is also heavy and expensive. Therefore, in embodiments promoted by the configuration of the produce pusher 210, the U-shaped frame 212 may exemplarily be constructed of stainless steel while the intermediate end fins 218 and intermediate center fins 220 are exemplarily constructed of another material including, but not limited to aluminum. Such an embodiment may exemplarily reduce a weight and a cost of the produce pusher 210, while retaining the strength and durability benefits of stainless steel embodiments by providing support and a strong exterior of the produce pusher 210 with the stainless steel U-shaped frame 212.

While not depicted in FIG. 8, it will be recognized that in an alternative embodiment, the fins 144 of different produce pushers 140 may be of different lengths such that the fins 144 of different produce pushers 140 engage the produce positioned within the target rings of the blade assembly at different relative positions of the pusher head 134 above the blade assembly 100. In such an exemplary embodiment, this focuses the slicing force generated by the pusher assembly 54 against less than all of the produce at the same time which can facilitate slicing of multiple pieces of produce with a lower overall required slicing force, as will be needed to slice all of the multiple pieces of produce simultaneously.

Figure 12:
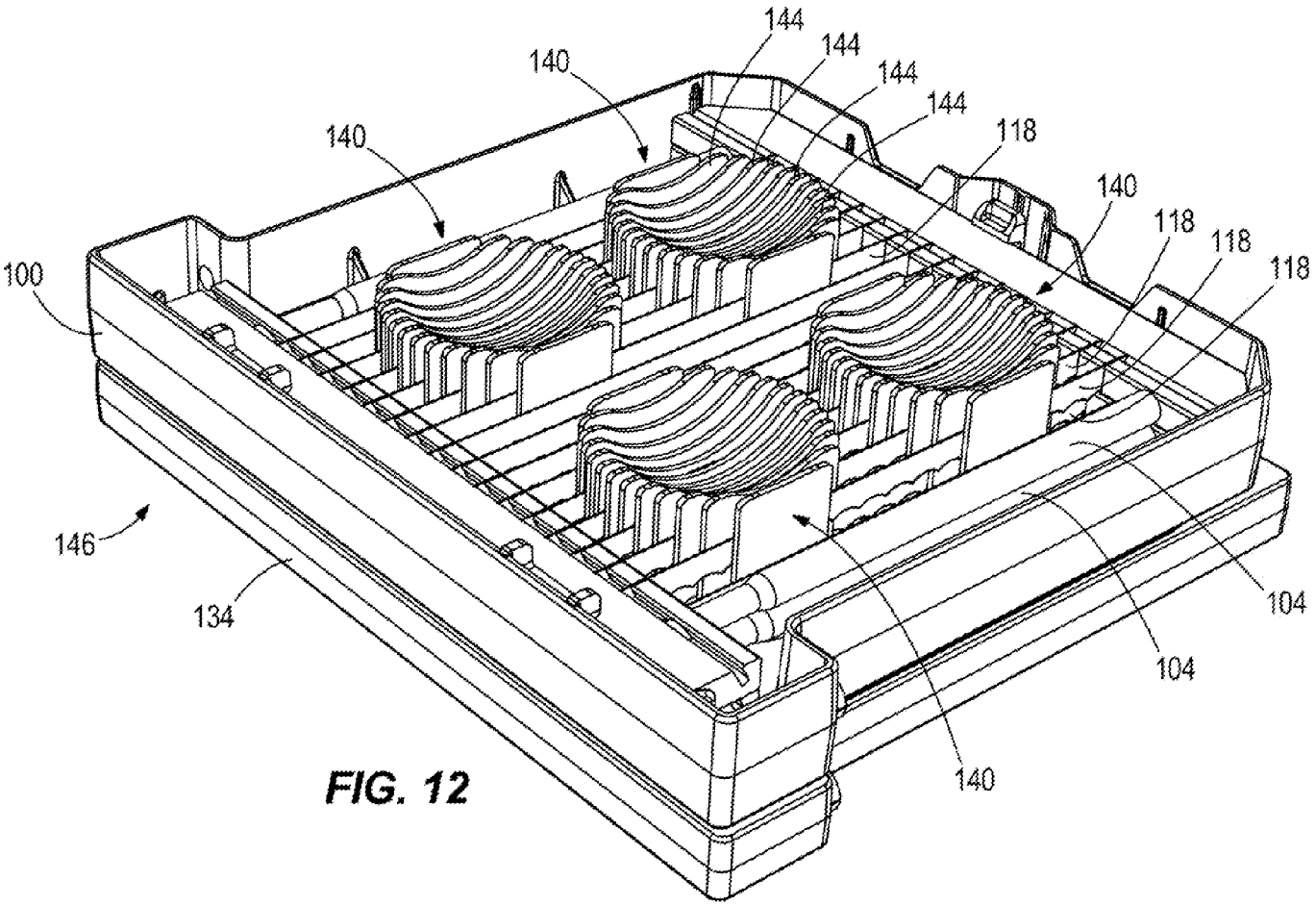
FIG. 12 is a bottom perspective view of a first embodiment a blade cartridge.

FIG. 12 is a bottom perspective view of an exemplary embodiment of the blade cartridge 146 including the blade assembly 100 depicted in FIGS. 5 and 6 and the pusher head 134 depicted in FIGS. 7 and 8 although it will be recognized that a pusher head using the produce pushers 210 depicted and described above with respect to FIGS. 9-11 may similarly be used. As can be seen in FIG. 12, when the blade assembly 100 and the pusher head 134 are in engagement with one another, the fins 144 of the produce pushers 140 extend in between adjacent blades 118 of the blade set 104. In an exemplary embodiment, the blade cartridge 146 in an arrangement wherein the blade assembly 100 engages the pusher head 134 may comprise an arrangement in which the blade cartridge 146 is stored, exemplarily when not in use.

As will be described in further detail herein, embodiments of the produce slicer 10 are configured to be operable with multiple configurations of blade cartridges, each blade cartridge specifically configured for optimal slicing of different types of produce, and, depending upon the produce, slicing multiple produce items simultaneously, such as with the blade cartridge just described with respect to FIGS. 5-12, which is exemplarily configured to slice four tomatoes or cucumbers with a single operation of the produce slicer 10. Embodiments of the blade cartridges are further configured, for example by arrangement of the one or more blade sets and/or pusher head, to execute different types of food preparation cuts, including but not limited to slicing, cubing, dicing, or wedging.

Figure 13:
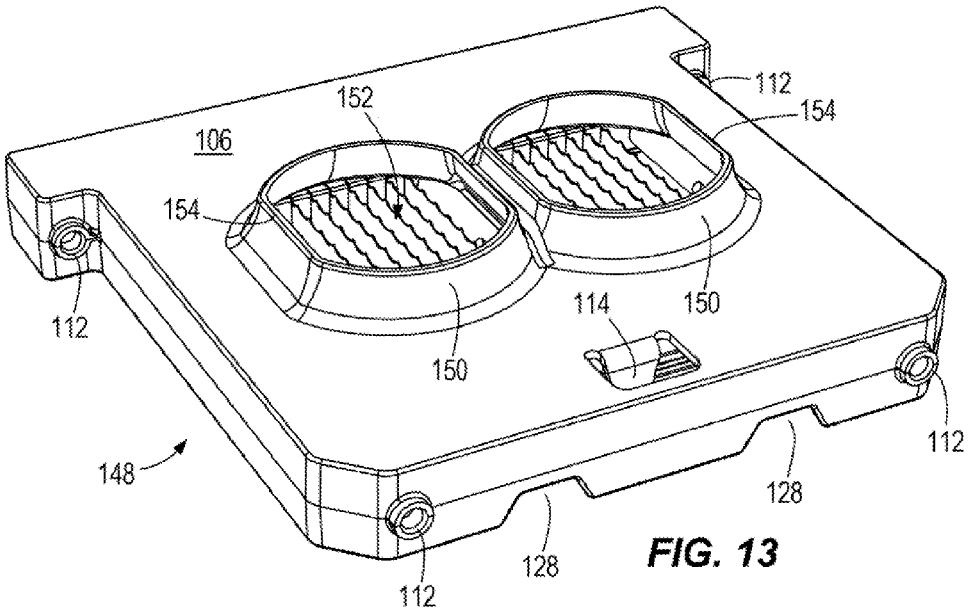
FIG. 13 is a top perspective view of an exemplary second embodiment of a blade assembly.

FIG. 13 is a top perspective view of a blade assembly 148 exemplarily configured to slice harder produce that requires more slicing force, for example slicing at least one onion or beet with a single operation of the produce slicer. The example depicted in FIG. 13 is configured to slice two pieces of produce. In an effort to promote clarity and conciseness between the description, like reference numerals between embodiments of the disclosed blade cartridges will be used to identify like structures between the embodiments.

It will be noted that the blade assembly 148 includes a top portion 106 as previously described and two target rings 150 that extend upward from the top portion 106 which are configured to receive produce (e.g. onions) positioned therein. In another aspect of embodiments as disclosed herein, it will be noted that the target rings 150 have a generally oblong configuration. This further facilitates the aforementioned desire to properly orient the produce relative to the underlying blade set 152. It will be exemplarily noted that in one dimension (e.g. looking top down) of an onion, and the onion is generally circular, while from another dimension (e.g. from the side), the onion is exemplarily oblong, particularly if the onion has received some form of pre-processing exemplarily as to remove the skin and/or topmost and bottommost ends of the onion. It is further noted that exemplarily in the food service industry, it is desirable to slice an onion in order to form onion rings and therefore to achieve this orientation of produce slice, the onion must be sliced through the oblong dimension. Therefore, the shape of the target rings 150 facilitate proper orientation of the onion produce relative to the blades of the underlying blade set. The retaining lip 154 of the target rings 150 also serve to hold the onions in this orientation as the produce is sliced. The target rings may also have flat surfaces or walls to further define and facilitate produce product alignment within the blade assembly. Additionally, since the blade assembly is exemplarily configured to slice a specific type of produce, spacing between adjacent blades of the blade set(s) may be specific to the produce to be sliced with that blade assembly. For example, onion spacing may be 3/16 inch, while tomato spacing may be ¼ inch. It will be recognized that if more than one blade set is used in a staggered configuration, then the distance is greater between adjacent blades within the same blade set. This may exemplarily be double the desired slice thickness, if two blade sets are used.

Figure 14:
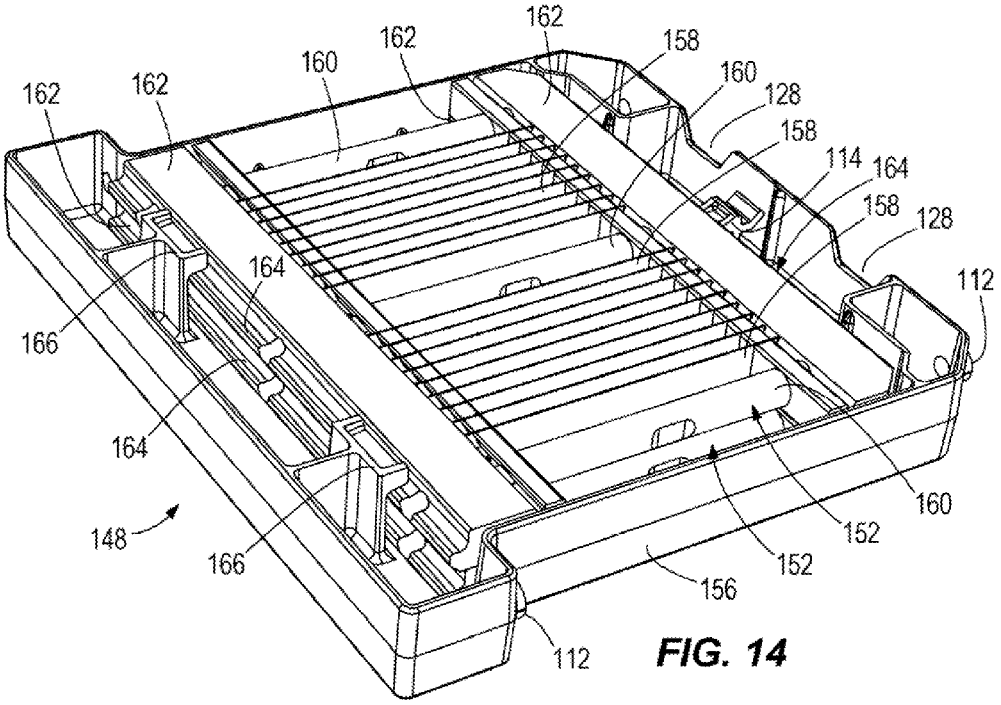
FIG. 14 is a bottom perspective view of the exemplary second embodiment of the blade assembly.

FIG. 14 is a bottom perspective view of an exemplary embodiment of the blade assembly 148. As previously mentioned, the blade assembly 148 is exemplarily configured to slice two pieces of produce (e.g. onions) with a single operation of the produce slicer. As can be seen from a comparison of FIG. 14 to FIG. 6 different configurations of the blade sets 152 and the blade cover 156 are presented. This different configuration presents improved blade tension and strength and support of the blade sets while being configured for use in the same frame 12 of the produce slicer 10. It will be recognized that the blade sets 152 are arranged to include shorter blades 158 and the blade sets 152 include three tensioning rods 160 with a tensioning rod disposed in the center of the blade set 152. The frame bars 162 of the blade set 152 include elongated lips 164. The lips 164 are configured to be engaged by the support ledges 166 at the front end of the blade assembly 148 and a similar elongated lip engaged by the finger 114 at the rear end of the blade assembly 148. These modifications facilitate the holding of the lowermost of the one or more blade sets 152 in a plane even with the lower edge 168 of the blade cover 156. Thus, in operation, the lowermost of the one or more blade sets 152 is directly supported by the support surface 24 of the frame base 20 of the produce slicer. In an exemplary embodiment, the ends of the frame bar 162 are supported on the lateral support 30 of the support surface 24. In order to accommodate the onion slicing blade assembly 148 in the frame 12 configured to receive multiple configurations of blade cartridges for slicing different types of produce, the blade cover 156 includes the cut-outs 128 at the rear end of the blade assembly 148; however, the respective support structures 40 of the frame 12 do not support the one or more blade sets 152, and rather, the support structures 40 are arranged adjacent to the rearmost frame bars 162 when the blade assembly is positioned within the frame 12, so that the lower most blade set 152 can engage the support surface 24.

Figure 15:
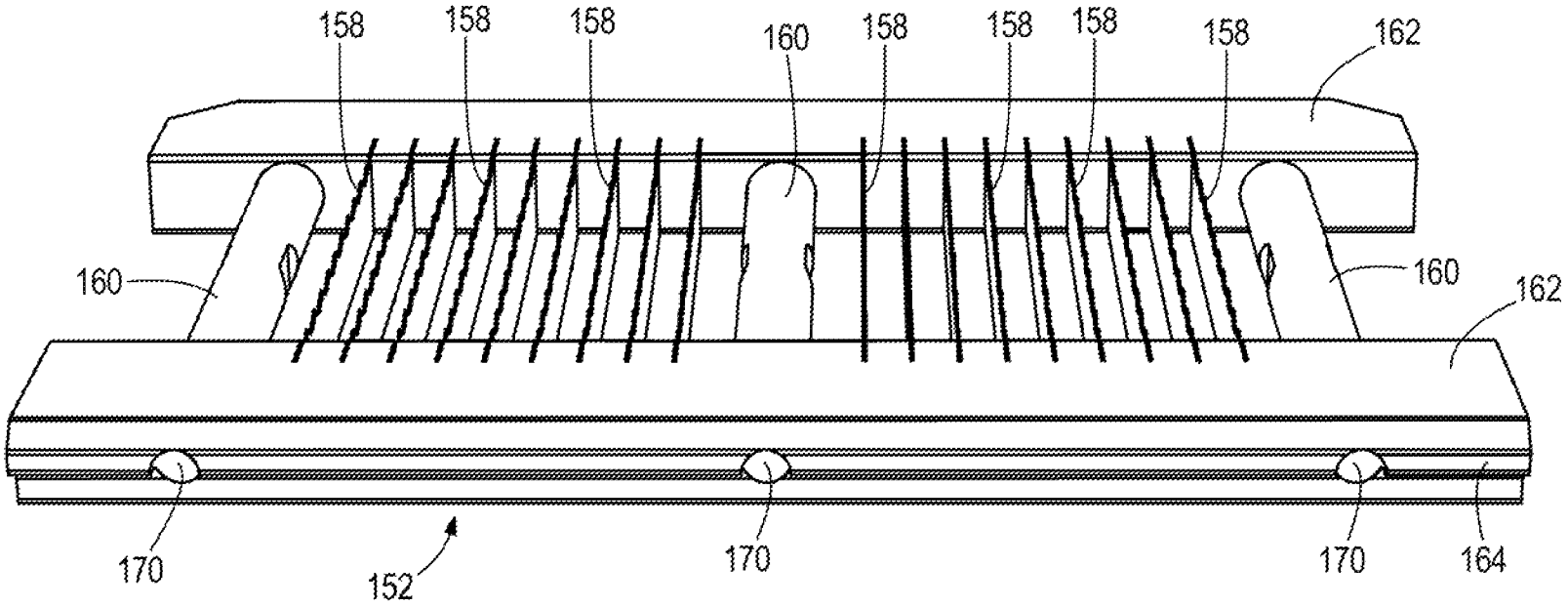
FIG. 15 is a front perspective view of an exemplary embodiment of a blade set for use with a blade assembly.
Figure 16:
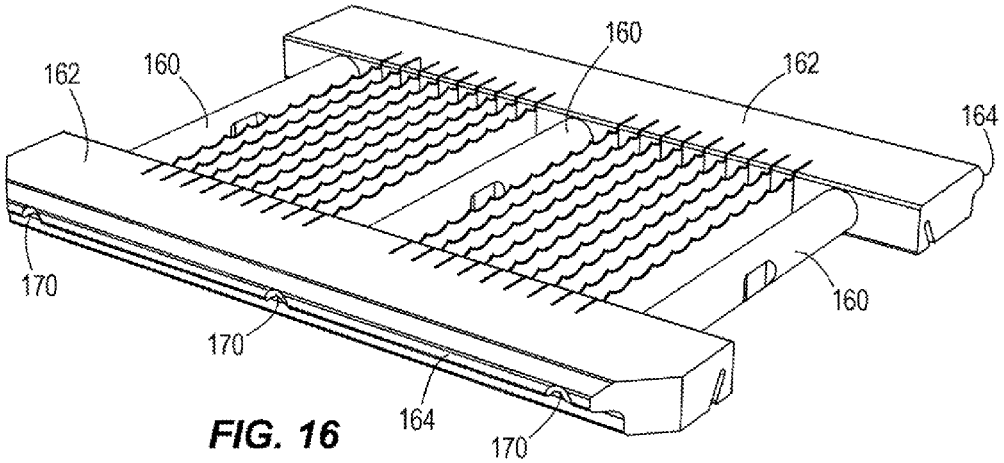
FIG. 16 is top perspective view of the exemplary embodiment of the blade set for use with a blade assembly.

FIGS. 15 and 16 depict exemplary embodiments of blade sets 152 and exemplarily may be used in connection with embodiments of the blade assembly 148 described above with respect to FIGS. 13 and 14. As can best be seen in FIG. 15, the frame bars 162 include through-holes 170 within which tensioning screws that extend through tensioning rods 160 are disposed and the tensioning screws in the through-holes are adjusted in order to achieve the required blade tension on the blades 158 of the blade set 152.

Due to the challenges of achieving a slicing force suitable to slice multiple pieces of hard produce (e.g. onions or beets) with a single actuation of the produce slicer while also slicing more delicate produce such as tomatoes and lettuce with the same produce slicer, still further embodiments of the blade set used in the blade assembly to cut onions may employ more than two blade sets such that the onions are held within the target ring at different heights relative to one another against the uppermost blade set associated with each onion by staggering the relative heights of the onion as positioned within the blade assembly. The pusher head as will be described in further detail herein applies the slicing force against the individual produce objects at different times thereby lowering the overall slicing force required through a single operation of the produce slicer to slice multiple pieces of produce.

In still another embodiment, the blade sets may hold the blades 158 at angles relative to each other as the angled blades reduce the blade surface engaging the produce at the start of the slicing operation thereby facilitating the initiation of the slicing of the produce. In one embodiment, the blades may be angled within a single blade set. In another embodiment, if two or more blade sets are used, blades may extend at angles between blade sets to create additional angulation of the blades in the blade assembly. In a still further embodiment, the blades are held straight by the blade sets, but held at one or more angles within the blade cover. This may exemplarily be achieved by adjusting a relative position between the finger and the support ledges. In another embodiment, if the blades within the blade assembly are angled sufficiently, then the produce may also be held at different heights relative to each other. As described above, this would result in application of the slicing force by the pusher head to each of the individual produce objects at different times in a single operation of the produce slicer.

Figure 17:
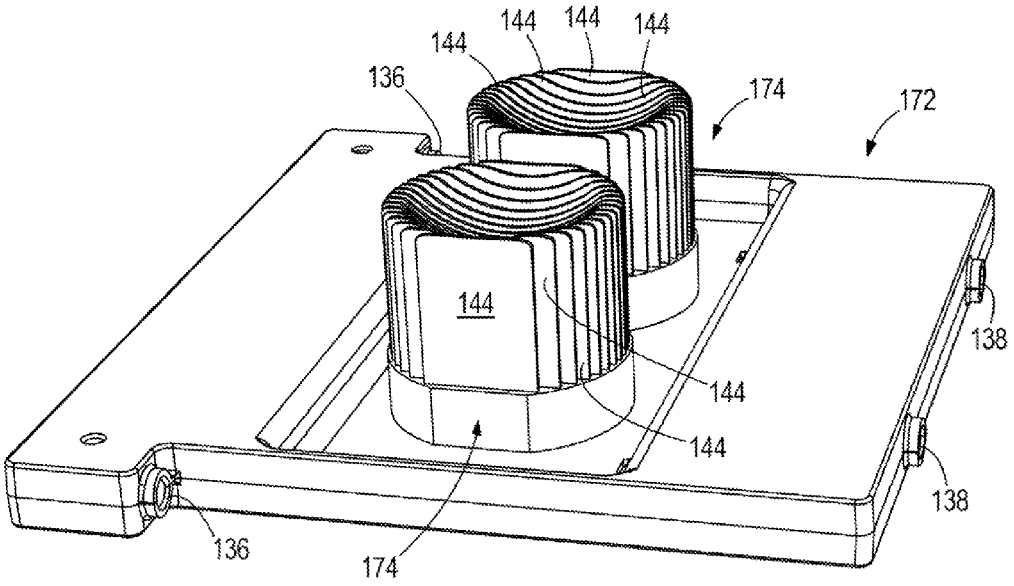
FIG. 17 is a bottom side perspective view of an exemplary second embodiment of a pusher head.

FIG. 17 depicts an exemplary embodiment of a pusher head 172 as may exemplarily be used with embodiments of the blade assembly 148 described above with respect to FIGS. 13 and 14. As will be recognized, the pusher head 172 includes two pusher assemblies 174 configured to apply the slicing force from the pusher assembly through the onion produce against the one or more blade sets of the blade assembly. As described above, in an alternative embodiment, the fins 144 of the respective pusher assemblies 174 may be of different relative heights such that the different pusher assemblies 174 engage the respective produce at different positions of separation between the pusher head 172 and the blade assembly 148 thereby focusing the slicing force from the pusher assembly against one of the pieces of produce first, thereby starting or completing slicing of one piece of produce before starting or completing slicing of another piece of produce with the other pusher assembly 174.

Figure 18:
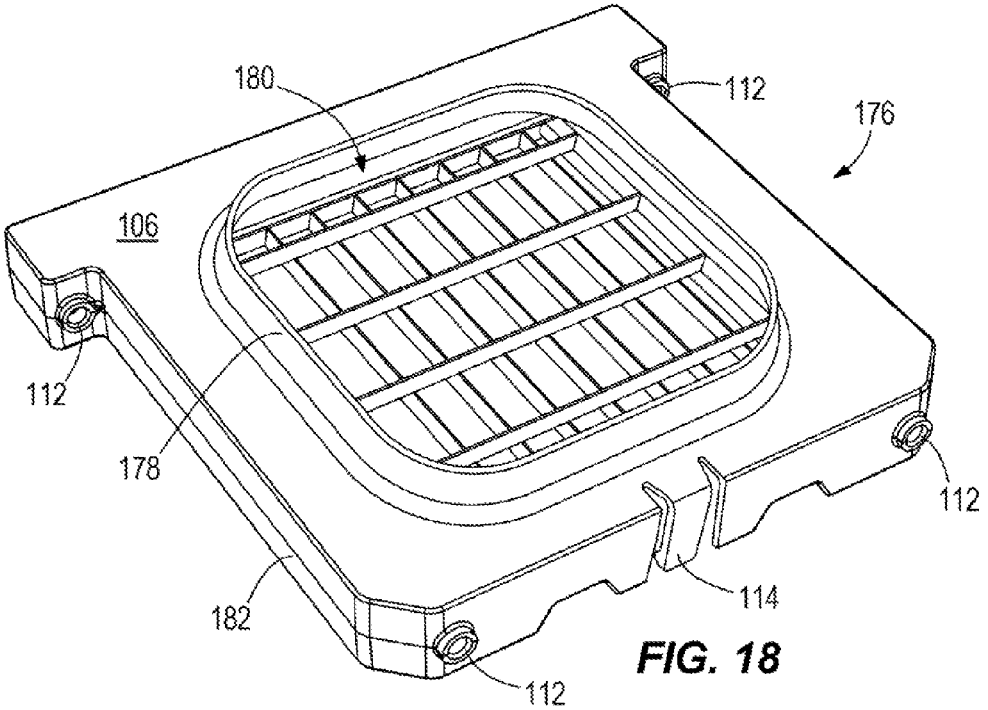
FIG. 18 is a top perspective view of an exemplary third embodiment of a blade assembly.
Figure 19:
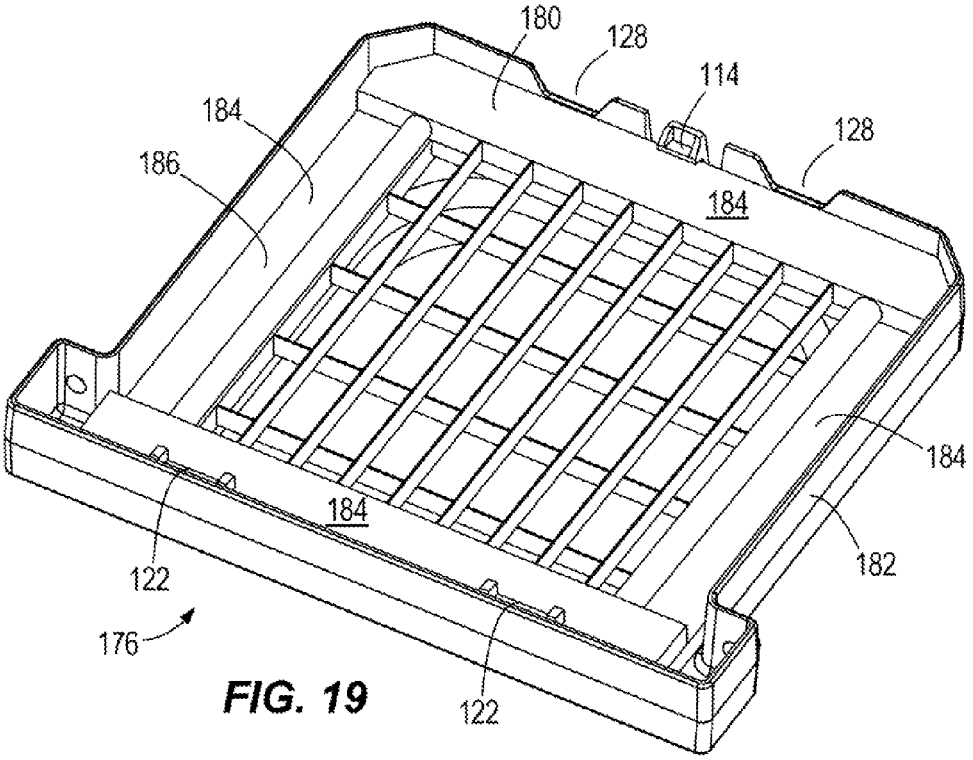
FIG. 19 is a bottom perspective view of the exemplary third embodiment of the blade assembly.

FIGS. 18 and 19 respectively depict top and bottom perspective views of an exemplary embodiment of a blade assembly 176. The blade assembly 176 may exemplarily be used to slice a single head of lettuce produce. Due to the relatively larger size of lettuce produce compared to other forms of produce (e.g. onions and tomatoes) a single target ring 178 defines a space to receive a single head of lettuce against an uppermost of the at least one blade set 180.

Viewing the blade assembly 176 from the bottom, in FIG. 19, the configuration of the blade cover 182 is more similar to that of the blade assembly configured for slicing the tomatoes described above with respect to FIGS. 5 and 6 than to the blade cover for the blade assembly configured for slicing onions described with respect to FIGS. 13 and 14. Due to the lower slicing force required to cut the head of lettuce as opposed to multiple onions, the blade cover arrangement wherein support ledges 122 engage the frame bar 184 of the bottom blade set 180 and similarly cut-outs 128 enables the support of the lowermost blade set 180 by the support structure 40 of the frame.

The blade assembly 176 further exemplarily discloses that the bottom blade set 180 and top blade set 186 may be oriented and held within the blade cover 182 at different orientations to one another rather than the offset orientation as described above with respect to the blade assembly configured to slice tomatoes and/or onions. Depending upon food processing requirements, lettuce is designed to be cut with a cross cut processing and therefore, the blade sets 180 are arranged within the blade cover 182 perpendicular to each other to achieve this desired slicing. As depicted in FIG. 19, the top blade set 186 is oriented perpendicular to the bottom blade set 180. The top blade set 186 is therefore supported by engagement with the bottom blade set 180 at respective ends of the frame bars 184, generally at the corners of the blade assembly 176. In a still further embodiment, due to the slicing requirements of a relatively soft piece of produce like lettuce, the blades of the blade sets 180, 186, may be flat and not serrated, and further may be untensioned, or held to a lower degree of tension than other embodiments. It will be recognized that other types of produce may also be processed with a cubing or dicing cut using such a configured blade assembly. It will be recognized that other angulations of blades may be used in other embodiments, for example to make wedge cuts.

In still further embodiments, each of the pusher head and blade assembly may include a handle that extends from the front side thereof. The handles can further facilitate the safe assembly and removal of the components of the blade cartridge into and from the frame of the produce slicer. In a still further embodiment, a handle link may be securable between the pusher head handle and the blade assembly handle. The handle link may rigidly define a distance between the blade assembly and the pusher head such that the blade assembly and pusher head are spaced apart at a predetermined distance for installation and removal of the blade cartridge from the frame of the produce slicer. In a still further embodiment, the predetermined distance established between the pusher head and the blade assembly can dispose the fins of the pusher head at least partially within the at least one blade set of the blade assembly to further block worker access to the blades during storage and/or cleaning of the blade cartridge. Additionally, by holding the pusher head and the blade assembly apart at a predetermined distance, cleaning of the component may further be facilitated.

An exemplary embodiment of a handle 200 is depicted on a blade assembly 202. In an embodiment, the handle 200 is D-shaped with a flat side 204 coplanar with the top portion 206 of the blade assembly 202. The handle 200 further includes a curved side 208 opposite the flat side 204. It will be recognized that a corresponding pusher head of a blade cartridge may similarly include a handle as described herein (e.g. as depicted in FIG. 3). In such an embodiment, when the pusher head is received within the blade assembly 202, corresponding flat sides of the handles are positioned in close proximity to one another such unitary handle is constructed with both curved sides of the respective handle.

Figure 20:
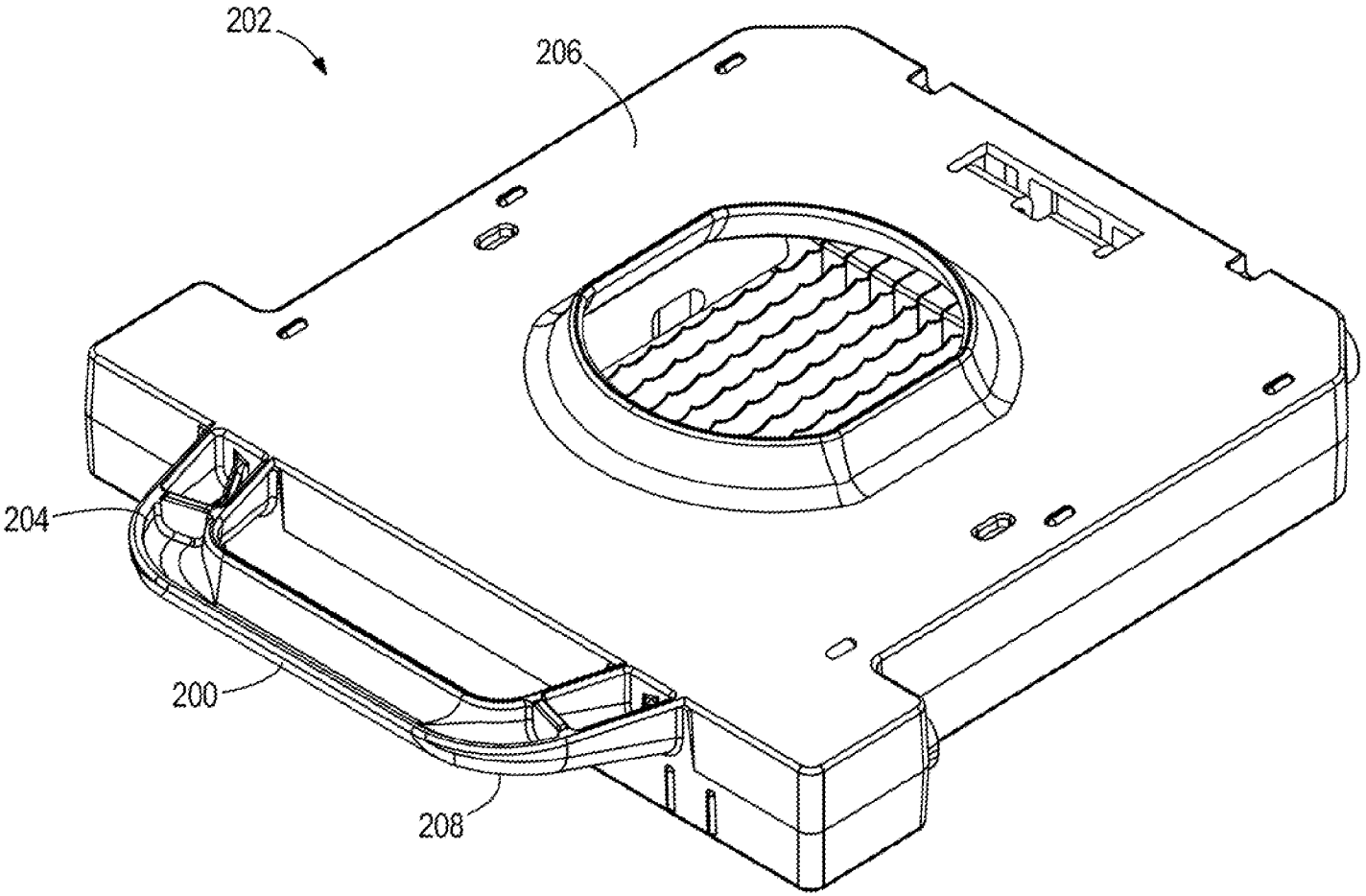
FIG. 20 is a top perspective view of an exemplary fourth embodiment of a blade assembly.
Figure 21:
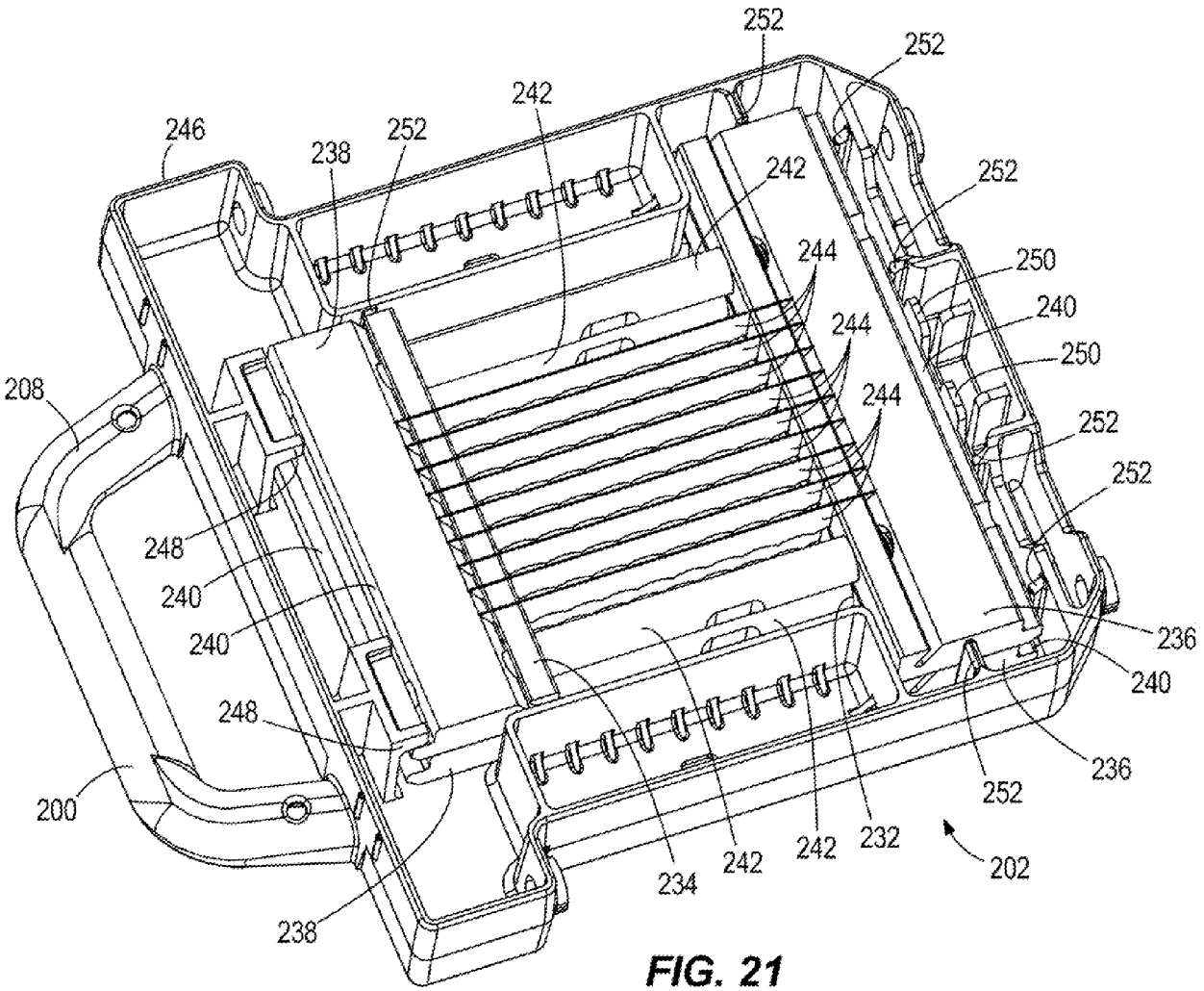
FIG. 21 is a bottom perspective view of the exemplary fourth embodiment of the blade assembly.

FIGS. 20 and 21 exemplarily depict a blade assembly 202 that is configured to slice a single piece of produce, which as non-limiting examples may include an onion or a beet. FIG. 21 is a bottom perspective view of the blade assembly 202. Similar to that as described above with respect to FIG. 14, the blade assembly 202 includes a top blade set 232 and a bottom blade set 234. The top blade set 232 and bottom blade set 234 are both generally constructed of an interior frame bar 236 and an exterior frame bar 238. Both the interior frame bar 236 and the exterior frame bar 238 include a lip 240. Tensioning rods 242 and blades 244 extend between the interior frame bar 236 and the exterior frame bar 238. The blade cover 246 includes a pair of support ledges 248 which engage a lip 240 of the exterior frame bar 238 of the bottom blade set 234 and a pair of fingers 250 that engage a lip 240 of the interior frame bar 236 of the bottom blade set 234. Thus, the top blade set 232 and bottom blade set 234 are retained within the blade cover 246 by the support ledges 248 and the fingers 250. The bottom blade set 234 is held in the position flush with the bottom of the blade cover 246 such that the interior frame bar 236 can exemplarily engage the sides of the support surface of the frame of the produce slicer while the exterior frame bar can engage the front supports of the support surface.

It will further be recognized that one or more projections 252 of the blade cover 246 extend from an interior of the blade cover 246 to engage the interior frame bar 236 or exterior frame bar 238. These projections 252 further distinctly define and locate the position of the top blade set 232 and the bottom blade set 234 within the blade cover 246 such as to achieve a proper positioning between the blade sets 232, 234, and the blade cover 246.

Figure 22:
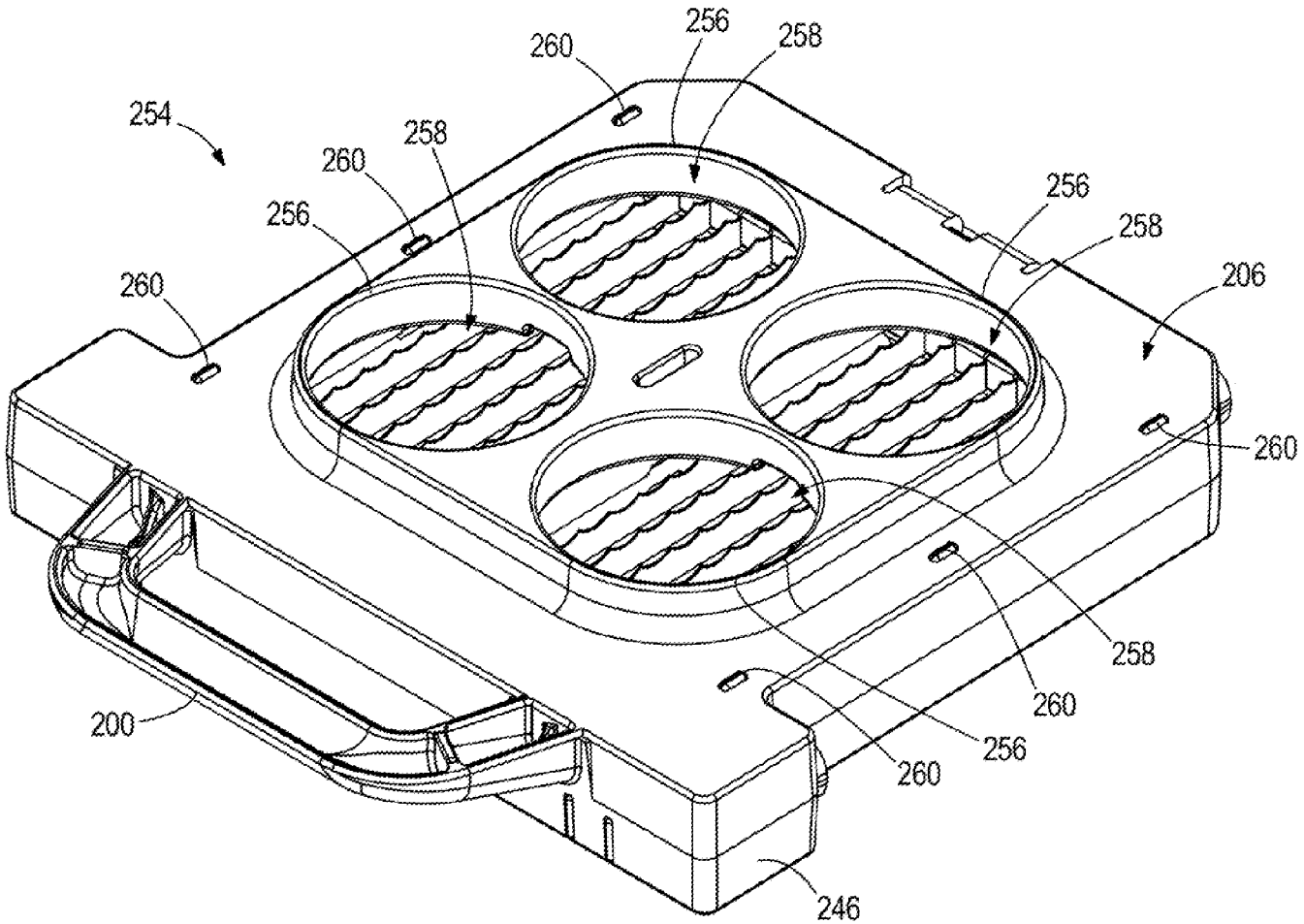
FIG. 22 is a top perspective view of an exemplary fifth embodiment of a blade assembly.
Figure 23:
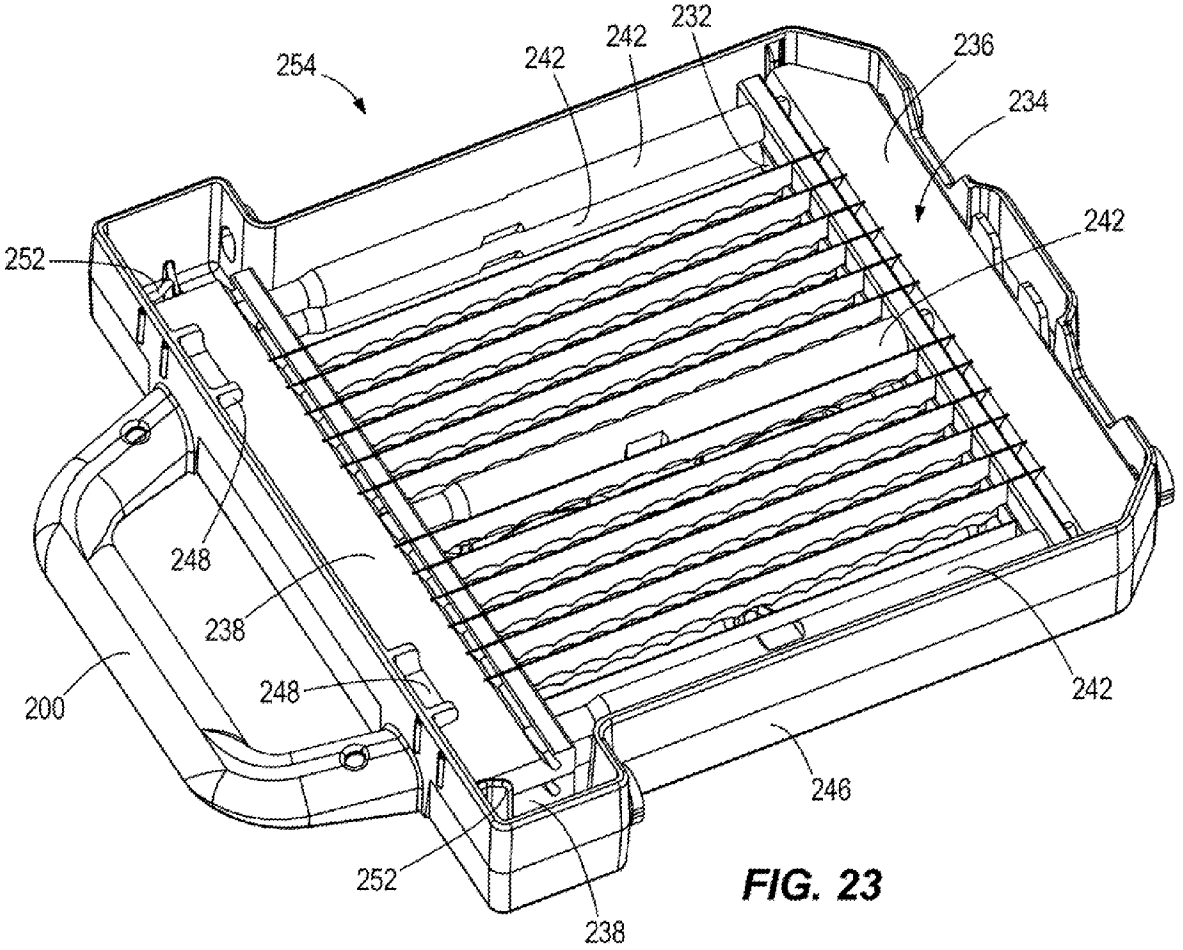
FIG. 23 bottom perspective view of the exemplary fifth embodiment of the blade assembly.

FIG. 22 is a perspective view of an additional exemplary embodiment of a blade assembly 254. Similar in construction to the blade assembly 202 depicted in FIGS. 20 and 21, the blade assembly 254 is exemplarily configured with four target rings 256, defining four target areas 258, exemplarily configured to receive a piece of produce within each of the target areas 258. Exemplarily, the piece of produce may be a tomato, while it will be recognized that other embodiments, as disclosed above, may be configured to slice one or more types of other forms of produce, including, but not limited to cucumbers or onions. In an embodiment, the blade assembly 254 may be used to simultaneously cut pieces of produce of two or more types of produce with similar physical properties, for example tomatoes and cucumbers. In that embodiment, the blades may all have similar qualities (e.g. tension, serration, support). In another embodiment the blade assembly 254 may be configured to simultaneously cut pieces of produce of two or more types of produce with different physical properties, for example tomatoes and onions. In that embodiment, different blades in the blade assembly may have different qualities (e.g. tension serration, support). Different qualities may be provided by providing a plurality of blade sets within the blade assembly 254 with different blade sets oriented relative to particular target areas 258 configured to receive a type of produce. The blade assembly 254 further includes a handle 200 that, as described above, is exemplarily configured to facilitate the transfer, storage, insertion, and/or removal of the blade assembly and/or the entire blade cartridge (not depicted) of the produce slicer.

As described above, in exemplary embodiments, a blade assembly and a pusher head may be configured to nestingly engage one another for common transport, cleaning, and/or storage. In an exemplary embodiment wherein the produce pusher of the pusher head is configured to be entirely received within the target ring 256, a top portion 206, or a cover surface of the blade cover 246 may engage a similar cover surface of a pusher head (not depicted). Exemplary embodiments of the blade cover 246 may include a plurality of spacers 260 extending upwards from the cover surface 206. This can limit the actual engaged surface area between the blade assembly and the pusher head when the two components are held together exemplarily for transport, cleaning, or storage. A reduction in engaged surface area promotes cleaning and drying of the cover surfaces as well as reduces adhesion between cover surfaces in the event of a moisture build up there between.

As discussed previously above, one or more blade sets may be used in an exemplary embodiment of a blade assembly. In embodiments of the blade set, the blades of the blade set are held in tension which enable the operation of the produce slicer by pushing the pieces of produce through the blade sets by a force applied by the produce pushers of the pusher head. However, forces on the blades during the cutting process may cause deflections or bending in the blades that over time reduce the tension in the blade set that worsens over time, reducing a useful life of the blade set. Therefore, in exemplary embodiments, the target rings 256 extend below a level of the cover surface 206 into the open interior of the blade cover 246 to produce one or more blade supports 262 which will be described in further detail herein, with respect to FIG. 24.

Figure 24:
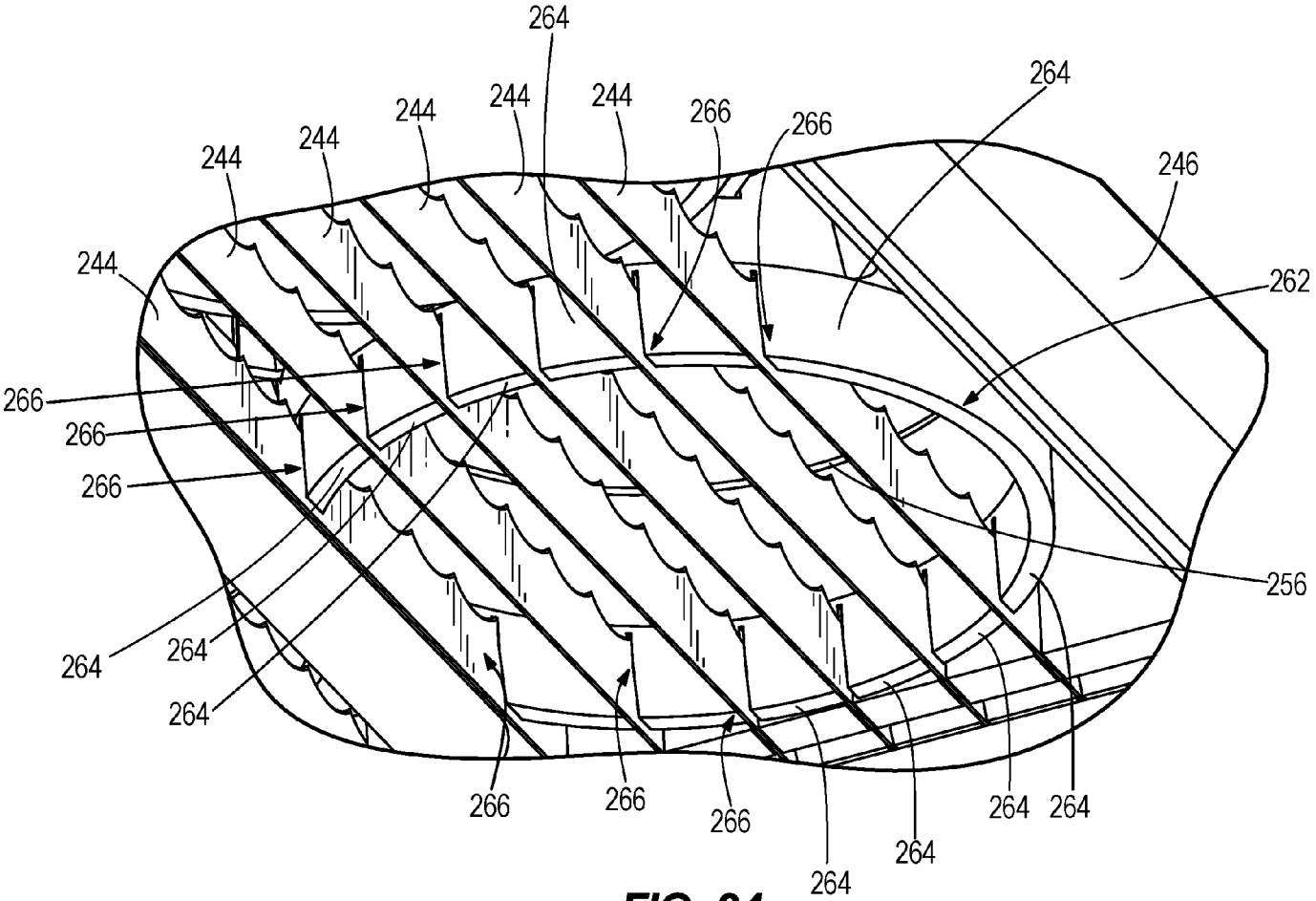
FIG. 24 is a bottom perspective view of an exemplary embodiment of a portion of a blade assembly.

FIG. 24 is a bottom perspective view of a portion of an exemplary embodiment of a blade set and a blade cover with a blade support 262. The blade support 262 is exemplarily constructed of a plurality of fingers 264 separated by blade slots 266. The blade supports 262 include a series of pairs of blade slots 266 each aligned to receive a single blade 244 of a blade set there between. Exemplarily, the blade slots 266 may be configured to receive only blades of a top blade set 232, as these are closest to the blade cover 246 and initiate cutting of the produce. In other embodiments, the blade support 262 includes slots for the blades of both a top blade set and a bottom blade set. It will be recognized that embodiments may include blade supports 262 associated with each of the plurality of target rings 256 in the blade cover 246. In such embodiments, blade slots 266 may be aligned between adjacent blade supports 262. In such an exemplary embodiment, each blade 244 of a blade set may therefore be supported by blade slots 266 of blade supports 262 at four locations across the length of the blade. The blade slots 266 are constructed within a sufficient manufacturing tolerance of the width of the respective blades so that the blades held in the blade slots 266 are supported from bending or rotation during the cutting process. This is exemplarily depicted in FIG. 24 in which a plurality of blades 246 can be seen supported by a plurality of blade slots 266 of the blade support 262. In still further embodiments, the blade supports 262 may be independent structures apart from the target rings 256. The blade supports may be secured to the blade set, or extend to the blades from another portion of the cover, for example the top portion or one or more of the sides.

Figure 25:
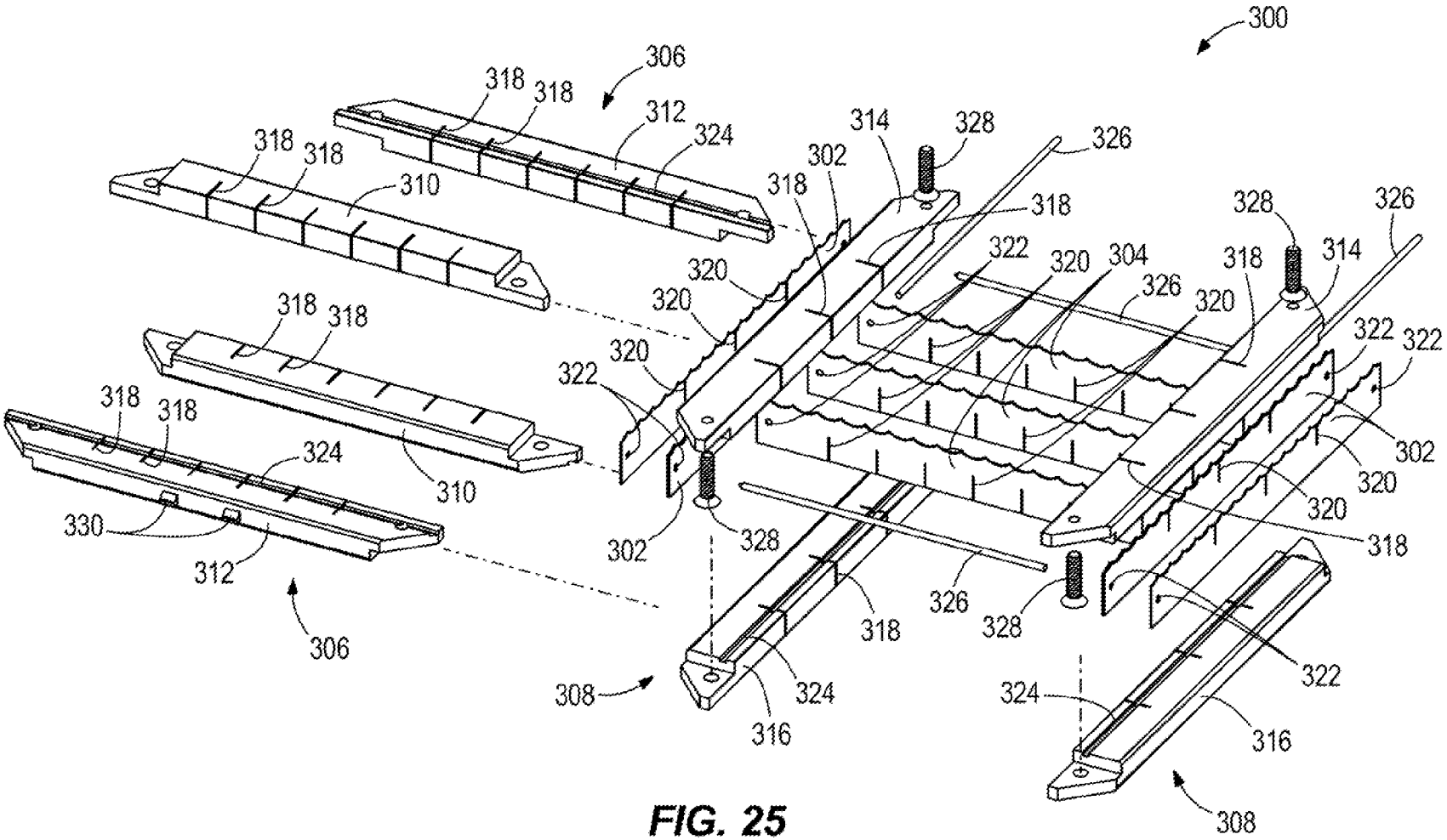
FIG. 25 is an exploded view of an exemplary embodiment of a blade set.

FIG. 25 is an exploded view of an additional exemplary embodiment of a blade set 300 as may exemplarily be used with embodiments of the blade assembly as disclosed herein. The blade set 300 may exemplarily be used to slice lettuce, although it will be recognized that such blade set 300 may be used to slice any of the other food as disclosed herein as well. Additionally, the blade set 300 may exemplarily be used in applications wherein a cut other than slicing may be desired, exemplarily, but not limited to shredding or cubing. This may be due to the fact that embodiments of the blade set 300 include at least two blades oriented in different directions to one another.

In FIG. 25, the blade set 300 includes at least one vertical blade 302 and at least one horizontal blade 304. The vertical blade 302 exemplarily extend between the horizontal frame bars 306 and the horizontal blade 304 exemplarily extend between the vertical frame bars 308.

The horizontal frame bars 306 are exemplarily constructed of top horizontal frame bars 310 and bottom horizontal frame bars 312. The vertical frame bars 308 are exemplarily constructed of top vertical frame bars 314 and bottom vertical frame bars 316.

A plurality of slots 318 in the frame bars are configured to respectively receive ends of the vertical blade 302 or horizontal blade 304. The vertical blades 302 and horizontal blades 304 further include slots 320 partially therethrough and configured to engage one another. Exemplarily in the embodiment depicted in FIG. 25, the vertical blades 302 and horizontal blades 304 are generally perpendicularly aligned.

The vertical blades 302 and horizontal blades 304 include holes 322 at respective ends. When the vertical blades are inserted within the slots 318 of the horizontal frame bars, the holes 322 of the vertical blades align with a groove 324 located through portions of both the top horizontal frame bar 310 and bottom horizontal frame bar 312. Similarly, when the horizontal blades 304 are located in the slots 318 of the vertical frame bars 308, the holes 322 of the horizontal blades 304 are aligned with grooves 324 located in the top vertical frame bar 314 and bottom vertical frame bar 316. Retaining rods 326 positioned through the holes 322 and arranged within the grooves 324 operate to retain the respective blades between the top and bottom portions of the frame bars when the blade set 300 is assembled.

When the blade set 300 is assembled, the retaining rods 326 are fully enclosed within the mating groove 324 of the respective top and bottom portions of the respective frame bars. This prevents removal of the blade from the respective slots 318 of the frame bars. Depending upon a dimensioning of the blades, grooves, and/or retaining rods, such tensioning may be applied to the blades during assembly of the blade set 300, although in other embodiments, the blades are generally untensioned.

In the embodiment depicted in FIG. 25, the blade set 300 is assembled by first orienting the bottom portions of the frame bars, then inserting the blades and the respective retaining rods into the slots 318 and grooves 324 before locating the top portions of the frame bars, enclosing the retaining rods 326 and the ends of the blade within the frame bars. Screws 328 exemplarily threadingly extend through the corners of all four portions of the frame bars where the structures over lap in the corners.

In an exemplary embodiment, at least one frame bar portion may include projections 330 which are configured to engage a blade cover as previously described. It will be recognized that, as described above, a variety of manners of connection between the blade set and the blade cover may be used and this embodiment may not be limited to the projections as shown in FIG. 25.

In an additional embodiment, the blade support is a separate structure (not depicted) apart from the blade cover. In an embodiment, the blade support comprises a plurality of fingers connected together to define a series of blade slots. This blade support embodiment may be placed in engagement with the blade set to receive a blade of the blade set into each of the blade slots. In an embodiment, the blade support or blade supports are configured with at least one mating feature or locking feature that engages a corresponding feature in the blade cover to secure the blade support thereto. In an embodiment, one or more blade supports may be secured to a blade set with the blades in engagement in the blade slots before the blades of the blade set are tensioned. In such an embodiment, the tension placed on the blades in the completed blade set secures the blade support in engagement with the blades of the blade set while the blade support strengthens the blades against twisting and/or bending during use.

Still further exemplary embodiments, it will be recognized that a blade assembly and a corresponding pusher head forming a blade cartridge may be configured for the simultaneously slicing of two different pieces of produce. As a non-limiting example, a blade cover of such a blade cartridge may be configured exemplarily with half of the blade cover as exemplarily depicted in FIG. 13 and the other half of the blade cover as exemplarily depicted in FIG. 5 to create a blade cover configured to receive one onion and two tomatoes for simultaneous slicing. The underlying blade sets of such a blade assembly may be constructed exemplarily as depicted in FIGS. 14-16 or FIG. 23 where the blades on either sides of the center tension rod are configured to different specification. Exemplarily, the spacing between the blades on either side of the center tension rod may be different to accommodate for exemplarily different widths of onion rings versus tomatoes slices. In still further embodiments, different features such as different blade tensioning and/or blade supports as described above may be used on either sides of the center tension rod to achieve different cutting qualities for use in slicing the different types of produce.

As previously described above, while not depicted herein, it is recognized that blade cartridges may be configured to perform other types of produce slicing, including, but not limited to dicing, cubing, slicing, or wedging. In an exemplary embodiment, a blade cartridge configured to perform a wedge cut, may include exemplarily six or eight angled blades radially extending from a central alignment rod with corresponding wedge-shaped fins on the pusher head. In such an embodiment, the central alignment rod and an exemplary support ring may form the frame for the blade set received in the blade assembly receiving area of the frame. In exemplary embodiments, the blades of the wedging blade set may exemplarily be located at different heights relative to the cover of the blade assembly as described above which may be achieved by two separate blade sets, or a single blade set with blades on different height levels. A non-limiting example of an exemplary construction of a wedging blade and a wedging produce pusher is exemplarily found in the 908-A series of heavy-duty wedges available from Prince Castle LLC.

In still further exemplary embodiments, the cover may comprise the top portion and be independently positioned relative to one or more blade sets positioned in the blade assembly receiving area of the frame. In one exemplary embodiment the cover may be directly secured to the one or more blade sets. In another example the cover may engage the frame, for example by sliding or pivotable attachment, such that one or more blade sets can be positioned within the blade assembly receiving area and the cover, with the target rings pivoted or otherwise moved into a position relative to the blade sets.

It will be recognized that the present disclosure has made reference to a plurality of exemplary embodiments. It will be recognized by a person of ordinary skill in the art in view of the present disclosure that various features and components as described in connection with one embodiment may be similarly applied or incorporated with the features of another embodiment disclosed herein, while remaining within the scope of the present disclosure.

Therefore, an embodiment of the produce slicer as disclosed herein, a single frame enables space-efficient storage and use within a confined food processor or preparation area. The frame of the produce slicer is configured to accept multiple different blade cartridges which include a blade assembly and a pusher head configured to slice different specific types of produce. While a single purpose slicer can be maximized to the specific slicing force and desired processed produce shape, the specific requirements of slicing each different type of produce present challenges when incorporating these features into a single produce slicer. Therefore, by making the adjustments relative to the specific produce within the blade cartridges and configuring the blade cartridges to be accepted within the single common slicer frame, the food processing worker can quickly and efficiently reconfigure the produce slicer for the type of produce to be processed. Additionally, the incorporation of the blade cover safely and securely retains the blade set for slicing each of the different types of produce in a manner that reduces accident risk to the worker thereby promoting a safer work environment while providing a blade assembly that is easily disassembled and cleaned to promote sanitation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A produce slicing system for slicing multiple types of produce, the produce slicing system comprising:

a frame comprising:

a frame base comprising a blade assembly receiving area;

a pusher assembly comprising at least one rail and a head receiver movably mounted to the at least one rail; and a handle movably connected to the pusher assembly and configured to move the pusher assembly along the at least one rail;

a first blade cartridge configured for interchangeable engagement with the frame, comprising:

a first blade assembly configured to removably engage the blade assembly receiving area of the frame base, comprising:

a first cover with a first cover top portion and a plurality of sides extending away from the first cover top portion defining an open interior;

at least one first cover target ring defined in the first cover top portion, the at least one first cover target ring defining at least one target area configured to receive produce to be sliced; and first and second blade sets, each comprising first frame bar and second frame bar, and a plurality of blades extending therebetween, the first and second blade sets retained within the open interior of the first cover; and a first pusher head configured to removably engage the head receiver of the frame, and comprising a first pusher head body and at least one produce pusher of the first pusher head with a plurality of fins extending in a direction away from the first pusher head body, the at least one produce pusher of the first pusher head aligned with the at least one first cover target ring; and a second blade cartridge configured for interchangeable engagement with the frame, comprising:

a second blade assembly configured to removably engage the blade assembly receiving area of the frame base, comprising:

a second cover with a second cover top portion and a plurality of sides extending away from the second cover top portion defining an open interior;

at least one second cover target ring defined in the second cover top portion, the at least one second cover target ring defining at least one target area configured to receive produce to be sliced; and third and fourth blade sets, each comprising a third frame bar and a fourth frame bar, and a plurality of blades extending therebetween, the third and fourth blade sets retained within the open interior; and a second pusher head configured to removably engage the head receiver of the frame, and comprising a second pusher head body and at least one produce pusher of the second pusher head with a plurality of fins extending in a direction away from the second pusher head body, the at least one produce pusher of the second pusher head aligned with the at least one second cover target ring.

2. The system of claim 1, wherein the first blade cartridge is configured to slice a first type of produce and the second blade cartridge is configured to slice a second type of produce.

3. The system of claim 2, further comprising:

wherein the frame base comprises a front support, lateral supports and at least one elevated support;

wherein the first frame bar of the first blade set engages the at least one elevated support and first cover further comprises at least one support ledge that engages the front support; and wherein the third frame bar of the third blade set engages the lateral supports and the fourth frame bar of the third blade set engages the front support.

4. The system of claim 1, wherein the frame further comprises at least one alignment structure located in the blade assembly receiving area and the first and second blade assemblies each comprise at least one alignment structure configured to matingly engage the at least one alignment structure of the blade receiving area, and the head receiver further comprises at least one alignment structure and the first and second pusher heads each comprise at least one alignment structure configured to matingly engage the at least one alignment structure of the head receiver.

5. The system of claim 4, wherein the first cover and the second cover further comprise laterally extending arms that engage the front support surface, each of the laterally extending arms comprising an alignment structure configured to matingly engage an alignment structure of the frame.

6. The system of claim 1, wherein the frame comprises:

a support surface and lateral walls defining the blade assembly receiving area in the frame base;

a first lock movably mounted to the frame base and configured to releasably retain the first blade assembly or the second blade assembly in engagement with the support surface and the lateral walls; and a second lock movably mounted to the head receiver and configured to releasably retain the first pusher head or the second pusher head in engagement with the head receiver.

7. The system of claim 1, further comprising:

a first handle extending away from the first blade assembly;

a second handle extending away from the first pusher head, wherein the first and second handles align when the first pusher head is engaged with the first blade assembly;

a third handle extending away from the second blade assembly;

a fourth handle extending away from the second pusher head, wherein the third and fourth handles align when the second pusher head is engaged with the second blade assembly.

8. The produce slicing system of claim 1, wherein the first blade set and the second blade set further each comprise three tension rods extending between the respective first and second frame bars of the first blade set and the first and second frame bars of the second blade set.

9. The produce slicing system of claim 1, wherein the at least one first cover target ring extends away from the first cover top portion in a direction away from the first blade set, and the first blade assembly further comprises a second target ring extending away from the first cover top portion in a direction away from the first blade set, the second target ring defining a second target area configured to receive a piece of produce to be sliced, and wherein the first pusher head further comprises a second produce pusher of the first pusher head with a plurality of fins extending in a direction away from the first pusher head body, the second produce pusher of the first pusher head aligned with the second target ring.

10. The produce slicing system of claim 1, wherein the at least one first cover target ring extends away from the first cover top portion in a direction opposite the open interior.

11. The produce slicing system of claim 10, further comprising a first handle extending away from the first blade assembly and a second handle extending away from the first pusher head, wherein the first and second handles align when the first pusher head is engaged with the first blade assembly.

12. The produce slicing system of claim 1, wherein the first cover further comprises at least one first cover support ledge and at least one finger extending into the open interior; and wherein the first frame bar and the second frame bar of the first blade set both comprise lips, the at least one support ledge engages a lip of the second frame bar and the at least one finger engages the lip of the first frame bar and the first frame bar further engages the lateral supports of the support surface and the second frame bar engages the front support.

13. The produce slicing system of claim 1, wherein the first cover further comprises an intermediate blade support that extends between and engages at least some blade of the plurality of blades.

14. The produce slicing system of claim 1, wherein the frame further comprises:

at least one rail, extending above the frame base, and the head receiver movably mounted to the at least one rail;

a handle and at least one arm movably connected between the frame base, head receiver and the handle, the handle operably configured to move the head receiver along the at least one rail between an elevated position and a lowered position; and a latch configured to passively engage when the head receiver is in the elevated position, the latch requiring an active disengagement to move the head receiver to the lowered position.

15. The produce slicing system of claim 1, further comprising:

wherein the at least one produce pusher comprises a base plate;

wherein the plurality of fins of the at least one produce pusher comprises side fins extending from the base plate, and a plurality of intermediate fins disposed between the plurality of side fins; and wherein the at least one produce pusher comprises a plurality of spacers disposed between each of the side fins and intermediate fins, and the spacers and intermediate fins are held under compression between the side fins.

* * * * *